US010603703B2

(12) United States Patent
Isogai et al.

(10) Patent No.: US 10,603,703 B2
(45) Date of Patent: Mar. 31, 2020

(54) METHOD OF MANUFACTURING PRESS-FORMED PRODUCT, AND PRESS-FORMED PRODUCT

(71) Applicant: NIPPON STEEL & SUMITOMO METAL CORPORATION, Tokyo (JP)

(72) Inventors: Eiji Isogai, Futtsu (JP); Nobusato Kojima, Himeji (JP); Riki Okamoto, Chiba (JP); Yutaka Mikazuki, Kimitsu (JP)

(73) Assignee: NIPPON STEEL CORPORATION, Tokyo (JP)

( * ) Notice: Subject to any disclaimer, the term of this patent is extended or adjusted under 35 U.S.C. 154(b) by 110 days.

(21) Appl. No.: 15/515,348

(22) PCT Filed: Sep. 30, 2015

(86) PCT No.: PCT/JP2015/077798
§ 371 (c)(1),
(2) Date: Mar. 29, 2017

(87) PCT Pub. No.: WO2016/052644
PCT Pub. Date: Apr. 7, 2016

(65) Prior Publication Data

US 2017/0232492 A1 Aug. 17, 2017

(30) Foreign Application Priority Data

Oct. 3, 2014 (JP) ..... 2014-205272
Jun. 5, 2015 (JP) ..... 2015-114974

(51) Int. Cl.
*B21D 7/06* (2006.01)
*B21C 37/08* (2006.01)
*B21D 5/01* (2006.01)

(52) U.S. Cl.
CPC ..... *B21C 37/08* (2013.01); *B21D 5/01* (2013.01); *B21D 7/06* (2013.01)

(58) Field of Classification Search
CPC . B21C 37/08; B21C 37/0803; B21C 37/0815; B21C 37/185; B21C 37/155;
(Continued)

(56) References Cited

U.S. PATENT DOCUMENTS 2,077,336 A * 4/1937 Lemming ..... B21D 5/015 72/398
2,983,995 A * 5/1961 Gresse ..... B21D 7/06 29/890.147
(Continued)

FOREIGN PATENT DOCUMENTS

CH 369091 5/1963
CN 101559455 A 10/2009
(Continued)

OTHER PUBLICATIONS

International Search Report for PCT/JP2015/077798 (PCT/ISA/210) dated Dec. 15, 2015.
(Continued)

*Primary Examiner* — Edward T Tolan
(74) *Attorney, Agent, or Firm* — Birch, Stewart, Kolasch & Birch, LLP

(57) ABSTRACT

The present invention provides a method of manufacturing a press-formed product. The method includes: a first process of preparing a material that is long in a first direction, and when viewed in a cross-section perpendicular to the first direction, the cross-section is a hollow cross-section that is long in a second direction perpendicular to the first direction; and a second process of bending the material in a
(Continued)

direction intersecting the second direction when viewed from the first direction, by pressing the material along the second direction.

9 Claims, 29 Drawing Sheets

(58) Field of Classification Search
CPC . B21D 5/01; B21D 5/015; B21D 5/10; B21D 7/00; B21D 7/06; B21D 7/02; B21D 7/022
See application file for complete search history.

(56) References Cited

U.S. PATENT DOCUMENTS

| | | | | | |
|---|---|---|---|---|---|
| 3,240,048 | A * | 3/1966 | Callendar | B21D 7/06 | 72/369 |
| 3,279,236 | A * | 10/1966 | Lance | B21D 7/06 | 72/396 |
| 3,667,269 | A * | 6/1972 | Bergner | B21D 7/06 | 72/166 |
| 4,148,426 | A * | 4/1979 | Midzutani | B21D 5/015 | 228/146 |
| 4,353,235 | A * | 10/1982 | Williamson | B21C 37/083 | 72/130 |
| 4,930,331 | A * | 6/1990 | Manning | B21D 22/025 | 72/370.23 |
| 5,694,683 | A * | 12/1997 | Teets | B21D 53/78 | 29/889.7 |
| 7,401,490 | B2 * | 7/2008 | Copeland | B21D 7/06 | 72/369 |
| 8,087,277 | B2 * | 1/2012 | Umeda | B21C 37/155 | 72/31.06 |
| 9,327,327 | B2 * | 5/2016 | Shinmiya | B21D 5/015 | |
| 9,421,594 | B2 * | 8/2016 | Ueno | B21D 5/015 | |
| 2006/0236737 | A1 * | 10/2006 | Shitamoto | B21C 37/08 | 72/51 |
| 2010/0011832 | A1 * | 1/2010 | Mizumura | B21D 7/06 | 72/369 |
| 2014/0096579 | A1 * | 4/2014 | Flehmig | B21D 5/015 | 72/51 |
| 2015/0165503 | A1 * | 6/2015 | Shinmiya | B21D 5/015 | 72/51 |
| 2017/0274434 | A1 * | 9/2017 | Sato | B21D 5/01 | |

FOREIGN PATENT DOCUMENTS

| | | | |
|---|---|---|---|
| CN | 101616758 | A | 12/2009 |
| CN | 102233510 | A | 11/2011 |
| CN | 102330034 | A | 1/2012 |
| CN | 102355962 | A | 2/2012 |
| CN | 103753118 | A | 4/2014 |
| DE | 100 62 836 | A1 | 6/2002 |
| DE | 10 2009 017 571 | A1 | 11/2010 |
| JP | 3-291115 | A | 12/1991 |
| JP | 7-63758 | B2 | 7/1995 |
| JP | 3114918 | B2 | 12/2000 |
| JP | 2002-219525 | A | 8/2002 |
| JP | 4644934 | B2 | 3/2011 |
| KR | 10-2010-0059103 | A | 6/2010 |
| RU | 2 014 165 | C1 | 6/1994 |
| RU | 2 018 397 | C1 | 8/1994 |
| WO | WO 2013/179628 | A1 | 12/2013 |
| WO | WO 2014/034885 | A1 | 3/2014 |

OTHER PUBLICATIONS

Written Opinion of the International Searching Authority for PCT/JP2015/077798 (PCT/ISA/237) dated Dec. 15, 2015.
Office Action dated Apr. 26, 2018, in Chinese Patent Application No. 201580053102.2, with partial English translation.
Office Action dated Jun. 1, 2018, in Russian Patent Application No. 2017111593/02(020463), with English translation.
Office Action dated Feb. 8, 2018, in Candian Patent Application No. 2,962,236.
Notice of Preliminary Rejection dated Feb. 14, 2018, in Korean Patent Application No. 10-2017-7009119, with English translation.
Notice of Allowance dated Nov. 16, 2018, in Korean Patent Application No. 10-2017-7009119, with English translation.

* cited by examiner

METHOD OF MANUFACTURING PRESS-FORMED PRODUCT, AND PRESS-FORMED PRODUCT

TECHNICAL FIELD OF THE INVENTION

The present invention relates to a method of manufacturing a press-formed product, and a press-formed product.

Priority is claimed on Japanese Patent Application No. 2014-205272, filed on Oct. 3, 2014, and Japanese Patent Application No. 2015-114974, filed on Jun. 5, 2015, the contents of which are incorporated herein by reference.

RELATED ART

In parts for a vehicle such as a suspension part, for example, a hollow pipe including a tubular portion (that is, a two-dimensionally curved tubular portion) that is curved in one virtual plane, and a hollow pipe including a tubular portion (that is, a three-dimensionally curved tubular portion) that is curved in two virtual planes intersecting each other are used so as to avoid interference with other parts while securing predetermined strength.

Patent Document 1 discloses a method of manufacturing a hollow pipe that includes a two-dimensionally curved tubular portion by pressing (press-forming) a flat plate in a thickness direction thereof.

PRIOR ART DOCUMENT

Patent Document

[Patent Document 1] Japanese Patent Publication No. 3114918

DISCLOSURE OF THE INVENTION

Problems to be Solved by the Invention

However, in the manufacturing method described in Patent Document 1, the hollow pipe including the two-dimensionally curved tubular portion can be manufactured through the pressing, but when manufacturing the hollow pipe including a three-dimensionally curved tubular portion by further pressing the hollow pipe, there is a problem that a forming defect such as a depression occurs. When the forming defect occurs, if a load is applied to the hollow pipe, stress concentration occurs, and rupture or cracking may occur. Accordingly, it is required to limit the occurrence of the forming defect such as the depression when forming a bent portion by pressing a hollow material so as to manufacture the hollow pipe that includes the three-dimensionally curved tubular portion and has stable strength through the pressing.

The invention has been made in consideration of the above-described situation, and an object thereof is to provide a method of manufacturing a press-formed product, and a press-formed product capable of limiting the occurrence of forming a defect such as a depression when forming a bent portion by pressing a hollow material.

Means for Solving the Problem

To solve the above-described problem, the invention adopts the following.

(1) According to an aspect of the invention, there is provided a method of manufacturing a press-formed product. The method includes a first process of preparing a material that is long in a first direction, and when viewed in a cross-section perpendicular to the first direction, the cross-section is a hollow cross-section that is long in a second direction perpendicular to the first direction, and a second process of bending the material in a direction intersecting the second direction when viewed from the first direction, by pressing the material along the second direction.

(2) In the aspect according to (1), the first process may include a flat plate bending process of pressing a flat plate along a thickness direction of the flat plate so that both ends in a width direction of the flat plate face each other, and a butting process of butting edges of the both ends of the flat plate after the flat plate bending process, and the flat plate after the butting process may be used as the material.

(3) In the aspect according to (2), the first process may further include a joining process of joining the edges of the flat plate after the butting process.

(4) In the aspect according to (2) or (3), in the flat plate bending process, the flat plate may be pressed in the thickness direction to allow the both ends in the width direction of the flat plate to face each other and to bend the flat plate in the thickness direction.

(5) In the aspect according to any one of (1) to (4), in the second process, the material may be pressed in stages along the second direction.

(6) According to another aspect of the invention, there is provided a press-formed product including a tubular portion that is long in one direction, and a bent portion that is provided in the tubular portion. A residual stress may be formed in the tubular portion and the bent portion along a circumferential direction.

(7) In the aspect according to (6), the press-formed product may further include a joint portion that is provided in at least one of the tubular portion and the bent portion, and the residual stress may be formed in the joint portion.

(8) In the aspect according to (6) or (7), at least one of a press trace or a sliding trace may be formed on an outer surface of the tubular portion.

Effects of the Invention

According to the aspects of the invention, it is possible to limit the occurrence of forming a defect such as a depression when forming a bent portion by pressing a hollow material.

EMBODIMENTS OF THE INVENTION

Figure 1:
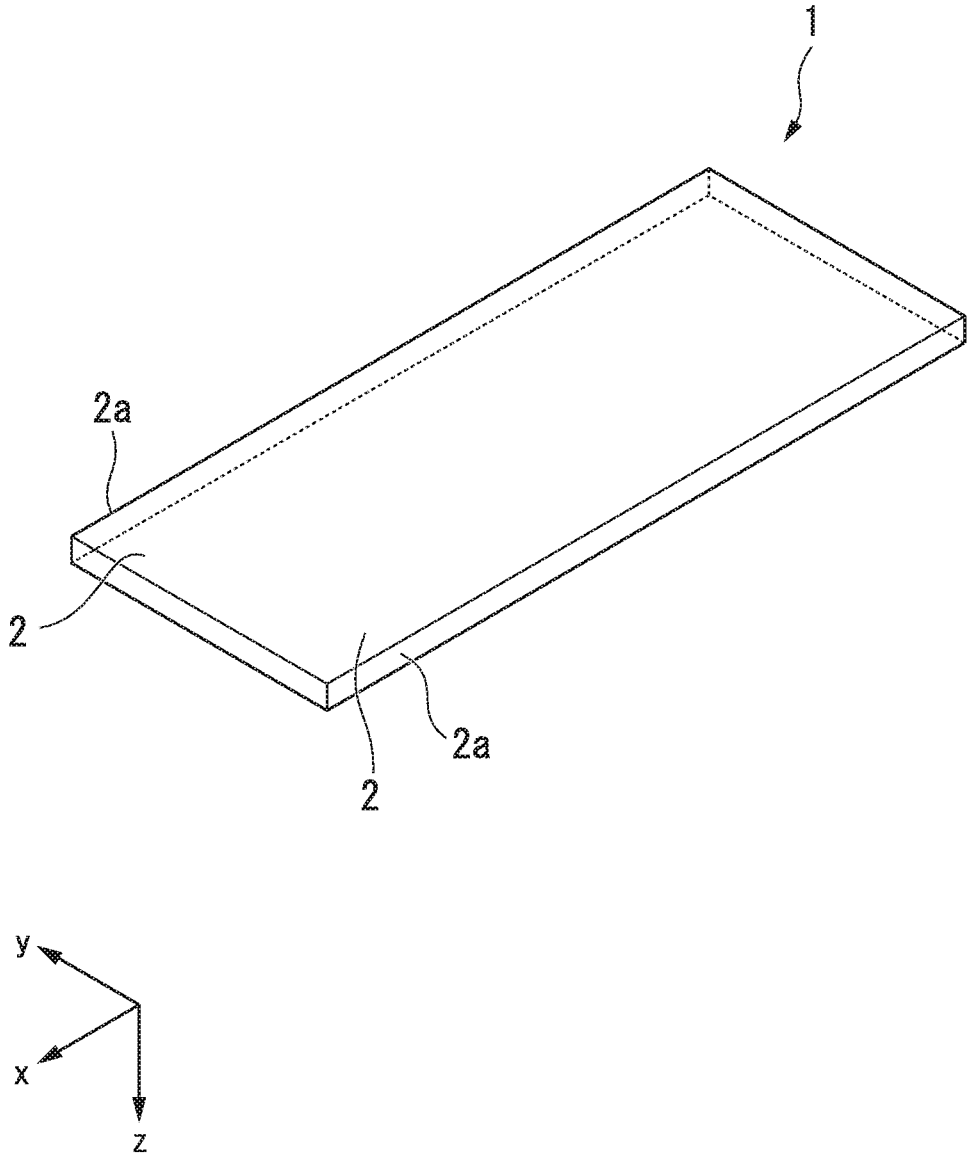
FIG. 1 is a perspective view showing a flat plate that is used in a method of manufacturing a press-formed product according to a first embodiment of the invention.

Hereinafter, embodiments of the invention will be described with reference to the accompanying drawings. Furthermore, in this specification and the drawings, the same reference numeral will be given to a constituent element having substantially the same function, and redundant description thereof will be omitted.

First Embodiment

FIG. 2A to FIG. 2D are views showing a press-formed product 50 according to a first embodiment of the invention.

Figure 2A:
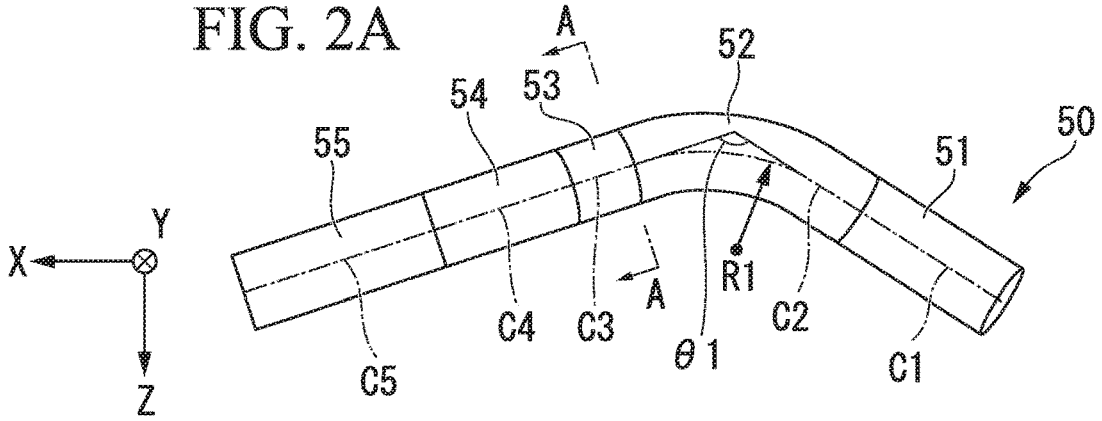
FIG. 2A is a front view showing the press-formed product according to the first embodiment of the invention.
Figure 2B:
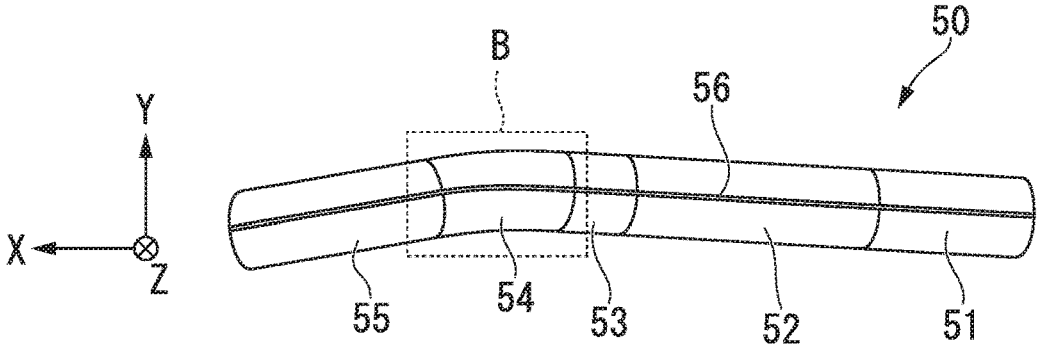
FIG. 2B is a plan view showing the press-formed product.
Figure 2C:
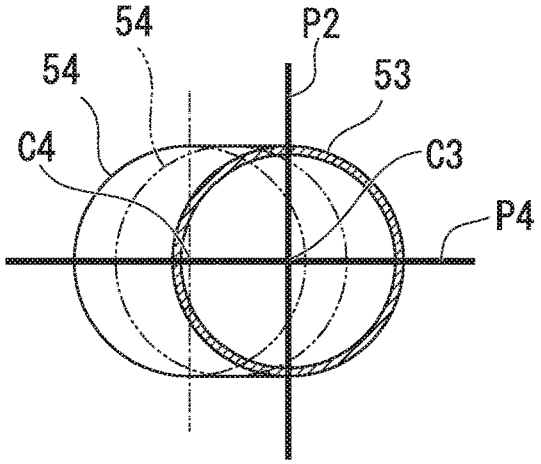
FIG. 2C is a cross-sectional view taken along line A-A in the press-formed product shown in FIG. 2A.
Figure 2D:
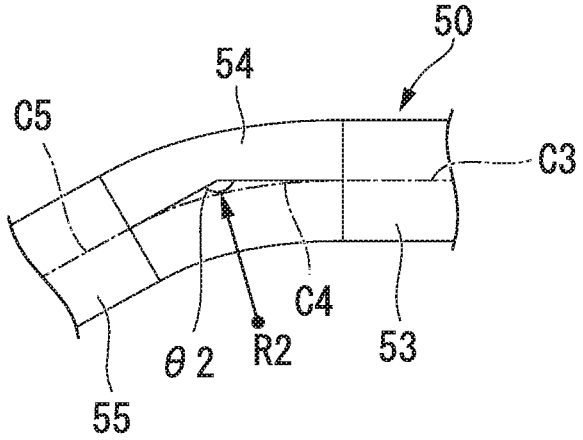
FIG. 2D is an enlarged view of a portion indicated by a symbol B in FIG. 2B.

FIG. 2A is a front view of the press-formed product 50, FIG. 2B is a plan view of the press-formed product 50, FIG. 2C is a cross-sectional view taken along line A-A in the press-formed product 50 shown in FIG. 2A, and FIG. 2D is an enlarged view of FIG. 2B. For example, the press-formed product 50 is suitably used in vehicle parts such as a rear side frame and a torsion beam side. In addition, for example, the press-formed product 50 may be used in a riding vehicle such as a motorcycle, a truck vehicle, a railway vehicle, a building material, a ship, and a household electric appliance, and the like without limitation to the above-described use.

The press-formed product 50 is manufactured by press-forming a flat plate 1 shown in FIG. 1. Furthermore, in FIG. 1, an x-direction represents a longitudinal direction of the flat plate 1, a y-direction represents a width direction of the flat plate 1, a z-direction represents a thickness direction of the flat plate 1, and the directions are perpendicular to each other.

For example, a material of the flat plate 1 is a metal such as iron, aluminum, stainless steel, copper, titanium, magnesium, and steel. The material of the flat plate 1 may be a plastically deformable material without limitation to the above-described materials. Furthermore, in a case of using a steel plate as the flat plate 1, it is preferable to use a hot-rolled 440 MPa-grade steel plate.

In addition, it is preferable that the thickness of the flat plate 1 is 0.5 to 10.0 mm, and more preferably 1.0 to 3.2 mm.

As shown in FIG. 2A to FIG. 2C, the press-formed product 50 has a cylindrical shape that is long in the X-direction (first direction). Specifically, the press-formed product 50 has a cylindrical shape having an outer diameter $\phi$ of 50.6 mm (inner diameter $\phi'$ of 47.4 mm), and a thickness t of 1.6 mm over the entire length. In addition, the press-formed product 50 includes three straight tubular portion 51, 53, and 55, a first curved tubular portion 52 (bent portion) that is provided between the straight tubular portion 51 and the straight tubular portion 53, a second curved tubular portion 54 (bent portion) that is provided between the straight tubular portion 53 and the straight tubular portion 55, and a welded portion 56 (joint portion) that is provided on an upper side. Furthermore, the welded portion 56 is provided in the press-formed product 50 by welding edges 2*a* (end surfaces in the width direction) of both ends 2 in the y-direction (width direction) of the flat plate 1.

Here, in FIG. 2A and FIG. 2B, an X-direction (first direction), a Y-direction (third direction), and a Z-direction (second direction) respectively correspond to the x-direction, the y-direction, and the z-direction in FIG. 1.

As shown in FIG. 2A, an axial line C2 of the first curved tubular portion 52 has a radius of curvature R1 of 126 mm. In addition, the first curved tubular portion 52 is curved so that an angle $\theta$1 between an axial line C1 of the straight tubular portion 51 and an axial line C3 of the straight tubular portion 53 becomes 130°. That is, the first curved tubular portion 52 of the press-formed product 50 is curved in a plane including the X-direction and the Z-direction.

As shown in FIG. 2D, an axial line C4 of the second curved tubular portion 54 has a radius of curvature R2 of 95 mm. In addition, the second curved tubular portion 54 is curved so that an angle $\theta$2 between the axial line C3 of the straight tubular portion 53 and an axial line C5 of the straight tubular portion 55 becomes 160°. That is, the second curved tubular portion 54 of the press-formed product 50 is curved in a plane including the X-direction and the Y-direction. Furthermore, in a case where the angle $\theta$2 is 160° or greater, it is possible to efficiently manufacture the press-formed product 50.

In addition, as shown in FIG. 2C (cross-sectional view along line A-A in the press-formed product 50 shown in FIG. 2A), in the press-formed product 50, when viewed from an A-direction shown in FIG. 2A, the axial line C4 of the second curved tubular portion 54 is formed in a plane P4 that is perpendicular to a plane P2 and includes the axial line C3 of the straight tubular portion 53. Here, the plane P2 is a plane that includes the axial line C1 of the straight tubular portion 51, the axial line C2 of the first curved tubular portion 52, and the axial line C3 of the straight tubular portion 53.

Figure 3:
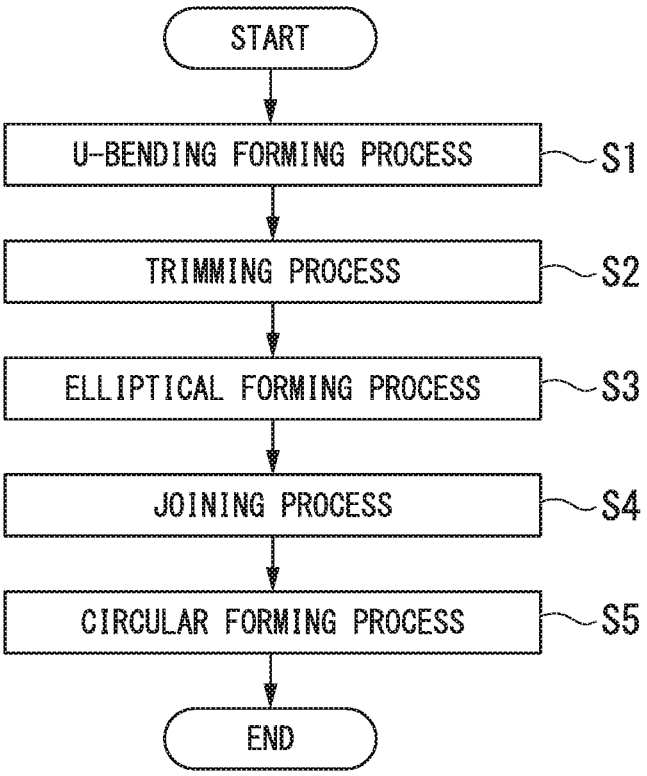
FIG. 3 is a flowchart showing the method of manufacturing the press-formed product according to the first embodiment of the invention.

Next, a description will be provided of a method of manufacturing the press-formed product 50 according to this embodiment. FIG. 3 is a flowchart showing the method of manufacturing the press-formed product 50 according to this embodiment.

As shown in FIG. 3, the method of manufacturing the press-formed product 50 includes a U-bending forming process S1, a trimming process S2, an elliptical forming process S3, a joining process S4, and a circular forming process S5. Furthermore, the processes are performed in a hot state or a cold state.

[U-Bending Forming Process S1]

Figure 4A:
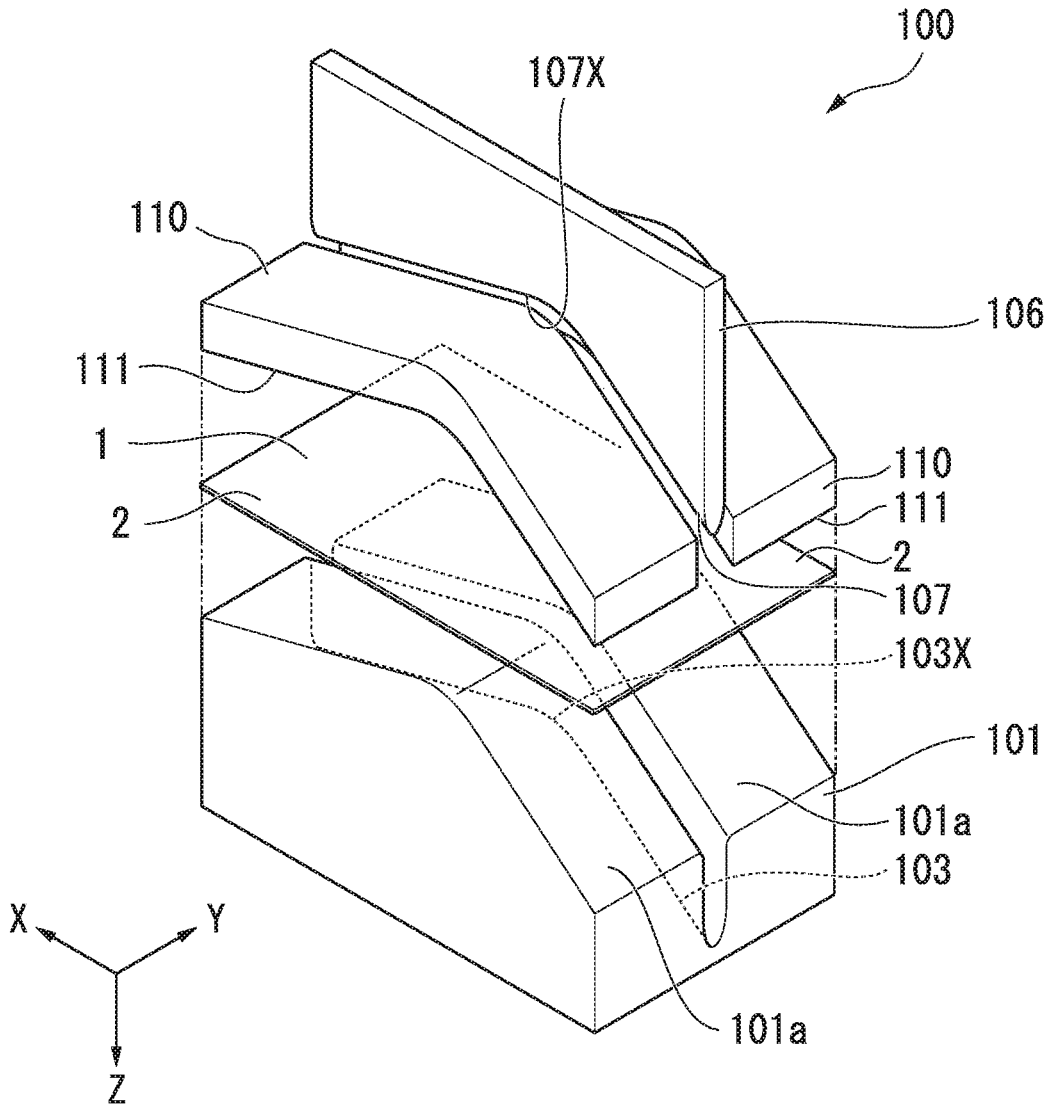
FIG. 4A is a perspective view showing a U-bending forming die according to the first embodiment of the invention.
Figure 4B:
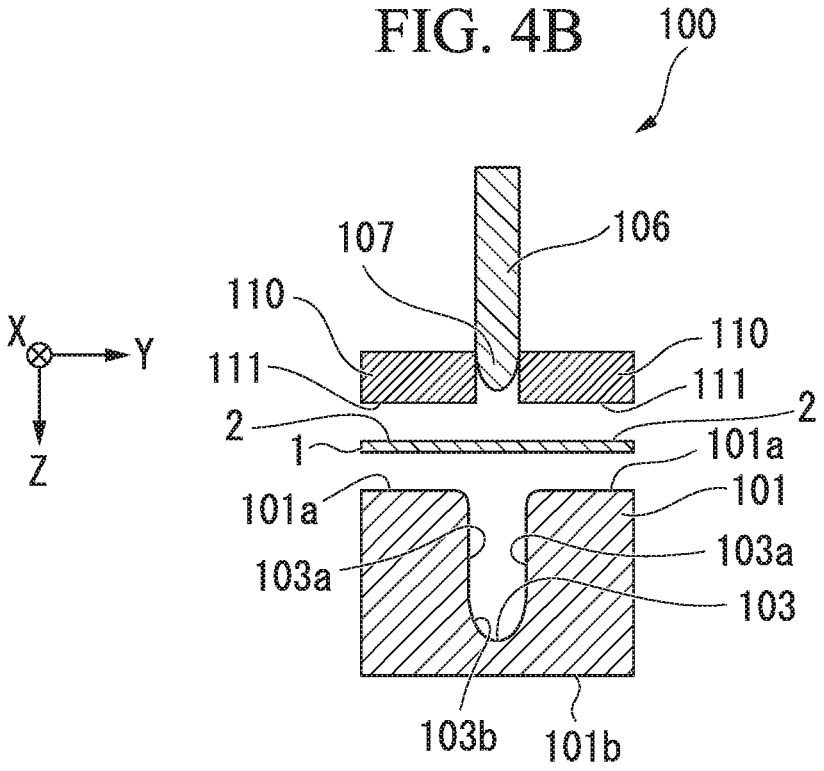
FIG. 4B is a transverse cross-sectional view showing the U-bending forming die.

In the U-bending forming process S1 (flat plate bending process), the flat plate 1 is pressed in a thickness direction by using a U-bending forming die 100 shown in FIG. 4A and FIG. 4B to allow both ends 2 of the flat plate 1 in a width direction to face each other, and to bend the flat plate 1 in the thickness direction. Furthermore, FIG. 4A is a perspective view showing the U-bending forming die 100, and FIG. 4B is a transverse cross-sectional view (cross-sectional view perpendicular to the X-direction) showing the U-bending forming die 100.

As shown in FIG. 4A and FIG. 4B, the U-bending forming die 100 includes a lower die 101, an upper die 106 that is disposed on an upper side of the lower die 101, and a pair of blank holder tools 110 which face the lower die 101 and are disposed with the upper die 106 interposed therebetween. When press-forming the flat plate 1, the flat plate 1 is disposed between the lower die 101 and the upper die 106. Furthermore, the lower die 101 and the upper die 106 are provided in a press-forming machine (not shown). The press-forming machine may be a typical press-forming machine, but a servo type press-forming machine, which is capable of arbitrarily adjusting a lower dead point of a die and a lowering velocity, is more preferable.

The lower die 101 of the U-bending forming die 100 includes a concave portion 103 that extends in the X-direction. As shown in FIG. 4B, the concave portion 103 is formed by a pair of lateral surfaces 103*a* that are parallel to the Z-direction and face each other, and a bottom surface 103*b* that is convex toward a bottom surface 101*b* of the lower die 101. In addition, as shown in FIG. 4A, the concave portion 103 has a shape in conformity to the axial lines C1, C2, and C3 (refer to FIG. 2A) of the press-formed product 50 when viewed from the Y-direction. According to this, a curved portion 103X for forming the first curved tubular portion 52 of the press-formed product 50 is formed partway along the concave portion 103.

As is the case with the bottom surface 103*b* of the concave portion 103, the blank holder tools 110 has a bottom surface 111 that faces an upper surface 101*a* of the lower die 101, and has a shape in conformity to the axial lines C1, C2, and C3 of the press-formed product 50. According to this, it is possible to press the flat plate 1 interposed between the upper surface 101*a* of the lower die 101 and the bottom surface 111 of the blank holder tools 110, and thus it is possible to limit the occurrence of wrinkles in the flat plate 1.

The upper die 106 of the U-bending forming die 100 includes a convex portion 107 on a lower side in the Z-direction. The convex portion 107 of the upper die 106 has a shape corresponding to the concave portion 103 of the lower die 101. In addition, as is the case with the concave portion 103 of the lower die 101, a curved portion 107X for forming the first curved tubular portion 52 of the press-formed product 50 is formed partway along the convex portion 107. In addition, the convex portion 107 of the upper die 106 enters the inside of the concave portion 103 of the lower die 101 when the upper die 106 is lowered along the Z-direction to make the upper die 106 and the lower die 101 approach each other.

In the U-bending forming process S1, first, as shown in FIG. 4A and FIG. 4B, the flat plate 1 is disposed on an immediately upward side of the lower die 101 of the U-bending forming die 100. In addition, the blank holder tools 110 are lowered along the Z-direction to press the flat plate 1 by the bottom surface 111 of the blank holder tools 110 and the upper surface 101*a* of the lower die 101 with the flat plate 1 interposed therebetween.

Figure 5:
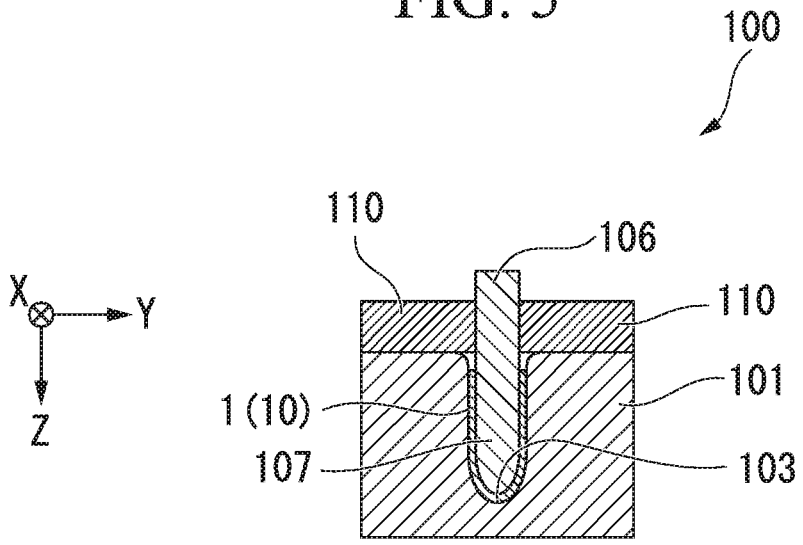
FIG. 5 is a transverse cross-sectional view showing the U-bending forming die and is a view showing a state in which an upper die is lowered to a lower dead point.

Subsequently, as shown in FIG. 5, the upper die 106 is lowered along the Z-direction up to the lower dead point to press-form the flat plate 1. At this time, the convex portion 107 of the upper die 106 presses the flat plate 1, and thus the flat plate 1 is drawn into a gap between the concave portion 103 of the lower die 101 and the convex portion 107 of the upper die 106. As a result, the flat plate 1 is press-formed in such a manner that the both ends 2 of the flat plate 1 in the width direction face each other, and thus it is possible to obtain an intermediate press-formed product 10 from the flat plate 1. As described above, the U-bending forming process S1 is completed.

Furthermore, since the flat plate 1 is interposed between the bottom surface 111 of the blank holder tools 110 and the upper surface 101*a* of the lower die 101 during press-forming of the flat plate 1, it is possible to limit the occurrence of buckling and wrinkles in the flat plate 1.

Figure 6A:
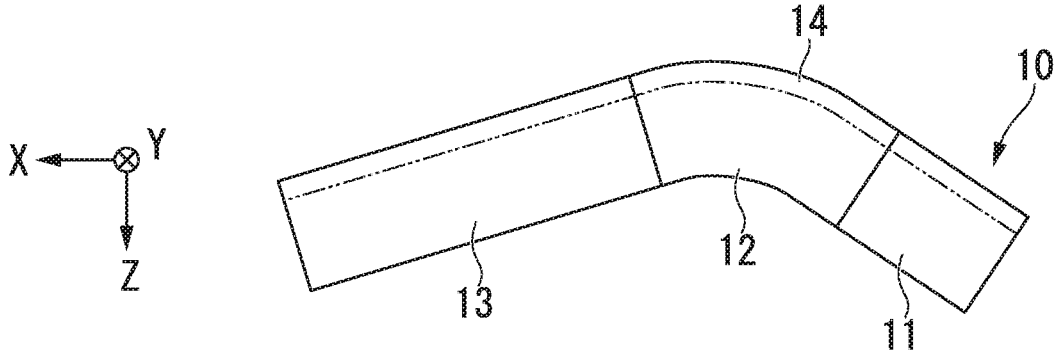
FIG. 6A is a front view showing an intermediate press-formed product that is obtained by press-forming a flat plate by using the U-bending forming die.
Figure 6B:
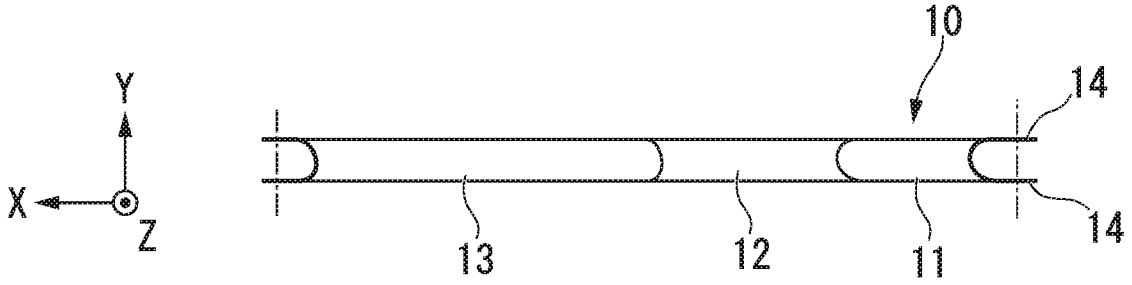
FIG. 6B is a bottom view showing the intermediate press-formed product.
Figure 6C:
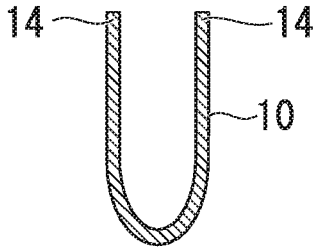
FIG. 6C is a transverse cross-sectional view showing the intermediate press-formed product.

FIG. 6A to FIG. 6C are views showing the intermediate press-formed product 10 obtained by the U-bending forming process S1. Furthermore, FIG. 6A is a front view of the intermediate press-formed product 10, FIG. 6B is a bottom view of the intermediate press-formed product 10, and FIG. 6C is a transverse cross-sectional view of the intermediate press-formed product 10. As shown in FIG. 6A to 6C, the intermediate press-formed product 10 has a U-shaped cross-section, and includes two linear portions 11 and 13, and a curved portion 12 that is formed between the linear portion 11 and the linear portion 13. Furthermore, the linear portion 11 corresponds to the straight tubular portion 51 of the press-formed product 50, the linear portion 13 corresponds to the straight tubular portions 53 and 55, and the second curved tubular portion 54 of the press-formed product 50, and the curved portion 12 corresponds to the first curved tubular portion 52 of the press-formed product 50 (refer to FIG. 2A). In addition, an excess metal 14 is formed in an upper end of the intermediate press-formed product 10.

[Trimming Process S2]

In the trimming process S2, the excess metal 14 of the intermediate press-formed product 10 obtained in the U-bending forming process S1 is removed by a trimming die 120.

Figure 7:
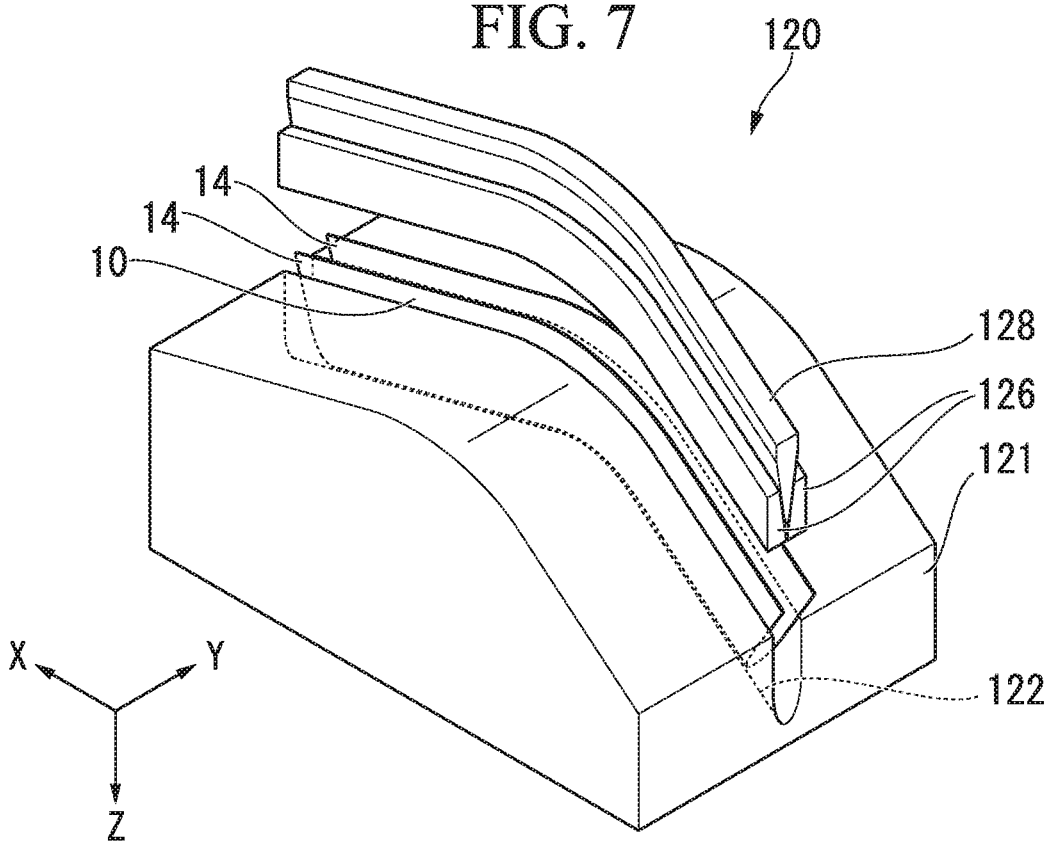
FIG. 7 is a perspective view showing a trimming die according to the first embodiment of the invention.

FIG. 7 is a perspective view showing the trimming die 120 that is used in the trimming process S2. As shown in FIG. 7, the trimming die 120 includes a stationary die 121, a pair of trimming blades 126 which are disposed on an upper side of the stationary die 121, and a wedge-shaped movable die 128 that is disposed between the pair of trimming blades 126.

The stationary die 121 of the trimming die 120 is provided with a concave portion 122 that extends in the X-direction. The concave portion 122 is different from the concave portion 103 of the lower die 101 of the U-bending forming die 100 in that a depth (length in the Z-direction) is smaller than in comparison to the concave portion 103. According to this, when the intermediate press-formed product 10 is placed along the concave portion 122 of the stationary die 121 of the trimming die 120, only the excess metal 14 of the intermediate press-formed product 10 is exposed from an upper surface of the stationary die 121.

In addition, the movable die 128 can move along the Z-direction. When the movable die 128 moves, the pair of trimming blades 126 can move in a direction to be spaced away from each other.

Figure 8:
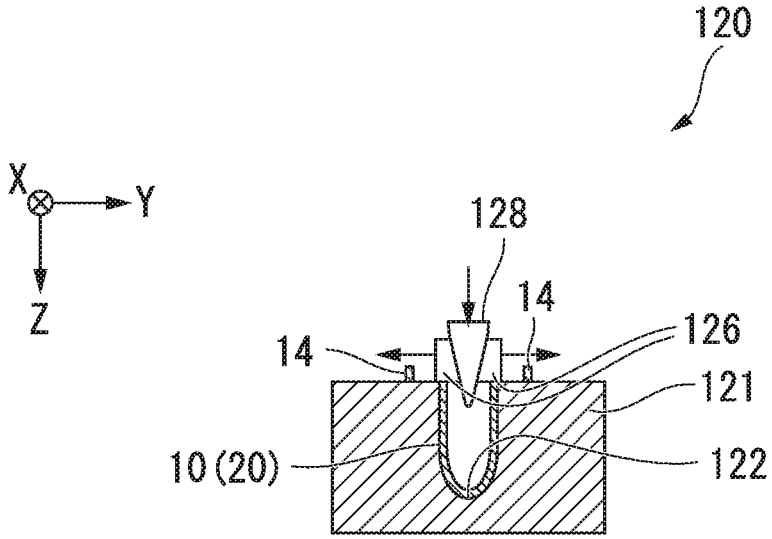
FIG. 8 is a transverse cross-sectional view showing the trimming die and is a view showing a state in which a movable die is lowered to a lower dead point.

In the trimming process S2, first, as shown in FIG. 7, the intermediate press-formed product 10 is placed on the stationary die 121 along the concave portion 122 of the stationary die 121. At this time, as described above, only the excess metal 14 of the intermediate press-formed product 10 is exposed from the upper surface of the stationary die 121. Subsequently, the pair of trimming blades 126 and the movable die 128 are lowered along the Z-direction so that the pair of the trimming blades 126 are located between the excess metals 14 of the intermediate press-formed product 10. Then, as shown in FIG. 8, the movable die 128 is further lowered along the Z-direction to allow the pair of the trimming blades 126 to move to both sides in the Y-direction. According to this, each of the excess metals 14 of the intermediate press-formed product 10 is removed. In this manner, the excess metal 14 is removed from the intermediate press-formed product 10, and the trimming process S2 is completed.

Figure 9A:
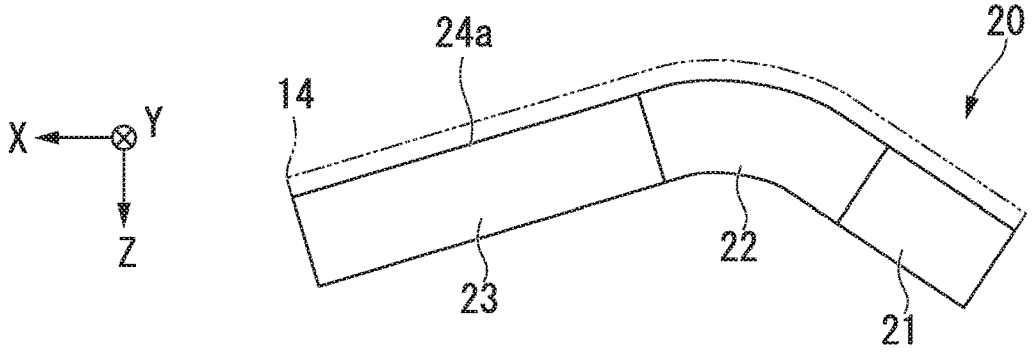
FIG. 9A is a front view showing an intermediate press-formed product from which an excess metal is removed by the trimming die.
Figure 9B:
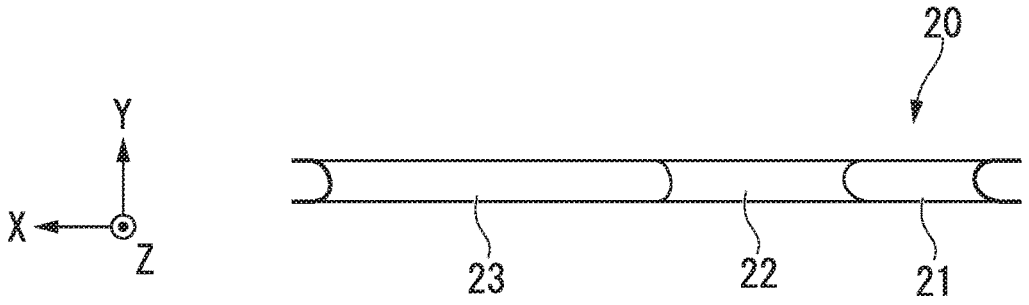
FIG. 9B is a bottom view showing the intermediate press-formed product.
Figure 9C:
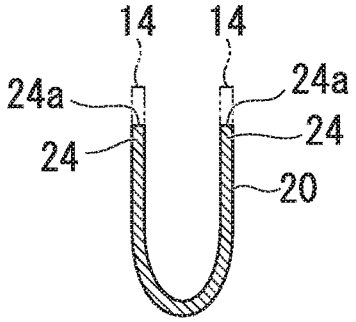
FIG. 9C is a transverse cross-sectional view showing the intermediate press-formed product.

FIG. 9A to FIG. 9C are views showing an intermediate press-formed product 20 that is obtained by the trimming process S2. Furthermore, FIG. 9A is a front view of the intermediate press-formed product 20, FIG. 9B is a bottom view of the intermediate press-formed product 20, and FIG. 9C is a transverse cross-sectional view of the intermediate press-formed product 20. As shown in FIG. 9A to FIG. 9C, the intermediate press-formed product 20 has a U-shaped cross-section, and includes two linear portions 21 and 23, and one curved portion 22. The linear portions 21 and 23 correspond to portions obtained by removing the excess metal 14 from the linear portions 11 and 13 (refer to FIG. 6A) of the intermediate press-formed product 10, and the curved portion 22 corresponds to a portion obtained by removing the excess metal 14 from the curved portion 12 of the intermediate press-formed product 10.

[Elliptical Forming Process S3]

In the elliptical forming process S3 (butting process), edges 24*a* (refer to FIG. 9A and FIG. 9C) of both ends 24 of the intermediate press-formed product 20 obtained in the trimming process S2 are butted against each other by an elliptical forming die 130.

Figure 10A:
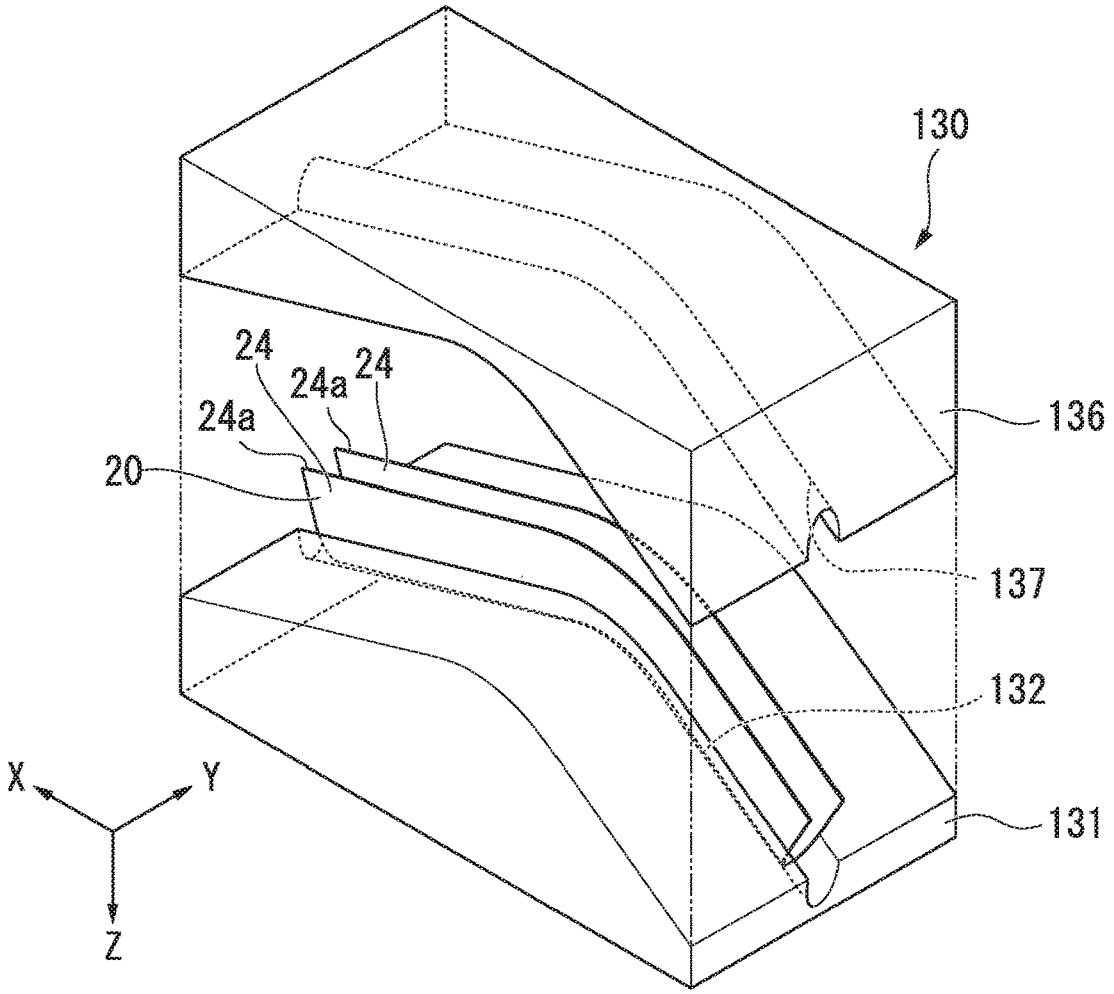
FIG. 10A is a perspective view showing an elliptical forming die according to the first embodiment of the invention.
Figure 10B:
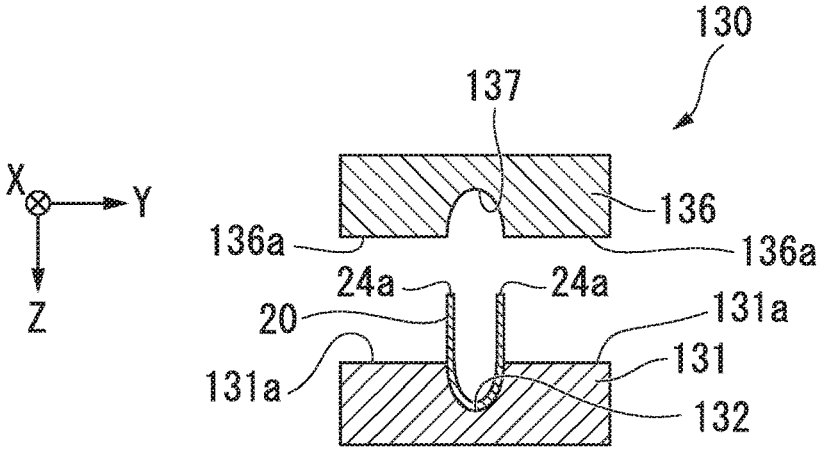
FIG. 10B is a transverse cross-sectional view showing the elliptical forming die.

FIG. 10A and FIG. 10B are views showing the elliptical forming die 130 that is used in the elliptical forming process S3. Furthermore, FIG. 10A is a perspective view of the elliptical forming die 130, and FIG. 10B is a transverse cross-sectional view of the elliptical forming die 130. As shown in FIG. 10A and FIG. 10B, the elliptical forming die 130 includes a lower die 131 and an upper die 136 that is disposed to face the lower die 131.

A concave portion 132, which extends in the X-direction, is formed in the lower die 131 of the elliptical forming die 130. The concave portion 132 is different from the concave portion 122 (refer to FIG. 7) of the stationary die 121 of the trimming die 120 in that a depth is smaller in comparison to the concave portion 122. According to this, in a state in which the intermediate press-formed product 20 obtained in the trimming process S2 is placed on the concave portion 132, an upper portion of the intermediate press-formed product 20 is exposed from an upper surface of the lower die 131.

Figure 11:
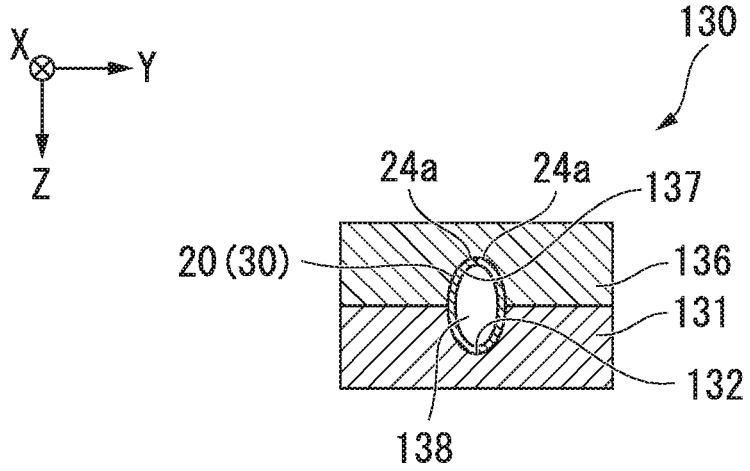
FIG. 11 is a transverse cross-sectional view showing the elliptical forming die and is a view showing a state in which an upper die is lowered to a lower dead point.

A concave portion 137, which faces the concave portion 132 of the lower die 131, is formed in the upper die 136 of the elliptical forming die 130. In addition, as shown in FIG. 11, in a state in which the upper die 136 is lowered in the Z-direction to come into contact with the lower die 131, a space 138 (forming space) is formed by the concave portion 132 of the lower die 131 and the concave portion 137 of the upper die 136.

In the elliptical forming process S3, first, as shown in FIG. 10A and FIG. 10B, the intermediate press-formed product 20 is placed on the lower die 131 along the concave portion 132 of the lower die 131. Then, as shown in FIG. 11, the upper die 136 is lowered in the Z-direction until a bottom surface 136*a* of the upper die 136 comes into contact with an upper surface 131*a* of the lower die 131. At this time, the concave portion 137 of the upper die 136 and the edge 24*a* of the intermediate press-formed product 20 come into contact with each other, and thus the intermediate press-formed product 20 is formed in a shape conforming to the concave portion 137. In addition, in a state in which the bottom surface 136*a* of the upper die 136 comes into contact with the upper surface 131*a* of the lower die 131, a pair of the edges 24*a* of the intermediate press-formed product 20 are butted against each other. In this manner, the intermediate press-formed product 20 is formed into an elliptical cross-sectional shape (elliptical shape), and the elliptical forming process S3 is completed.

Figure 12A:
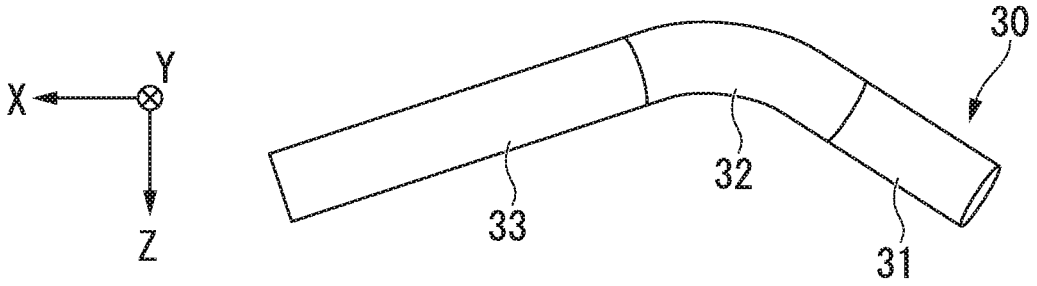
FIG. 12A is a front view showing an intermediate press-formed product that is obtained by the elliptical forming die.
Figure 12B:
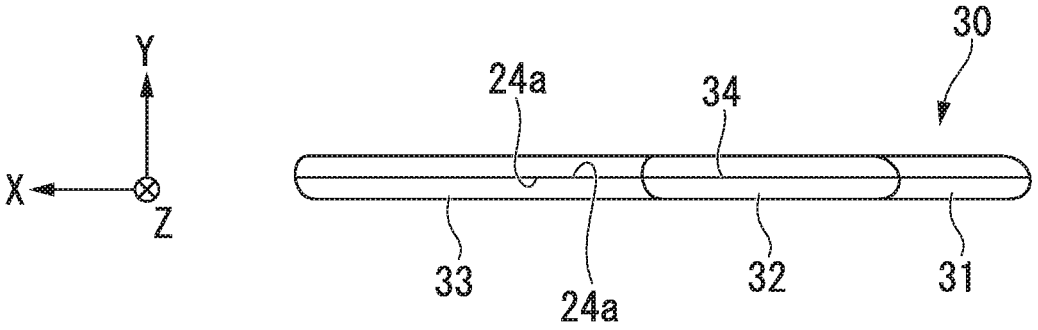
FIG. 12B is a plan view showing the intermediate press-formed product.
Figure 12C:
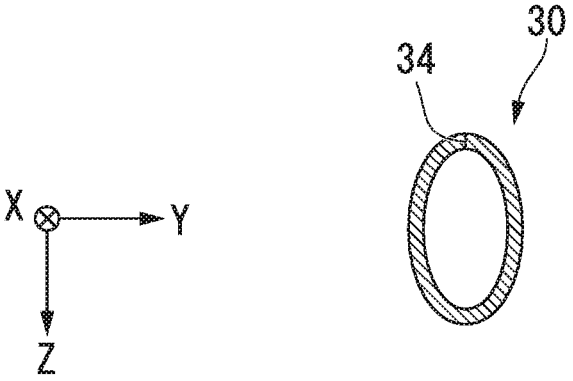
FIG. 12C is a transverse cross-sectional view showing the intermediate press-formed product.

FIG. 12A to FIG. 12C are views showing an intermediate press-formed product 30 that is obtained in the elliptical forming process S3. Furthermore, FIG. 12A is a front view of the intermediate press-formed product 30, FIG. 12B is a plan view of the intermediate press-formed product 30, and FIG. 12C is a transverse cross-sectional view of the intermediate press-formed product 30. As shown in FIG. 12A to FIG. 12C, the intermediate press-formed product 30 has a hollow elliptical cross-section, and includes two linear portions 31 and 33, and one curved portion 32. In addition, the intermediate press-formed product 30 is formed by butting the both edges 24*a* of the intermediate press-formed product 20, and thus a joint portion 34 is formed.

[Joining Process S4]

In the joining process S4, the joint portion 34 of the intermediate press-formed product 30 is joined through welding (that is, the pair of edges 24*a* are joined). Furthermore, as the welding, arc welding, laser welding, or the like can be used.

Figure 13A:
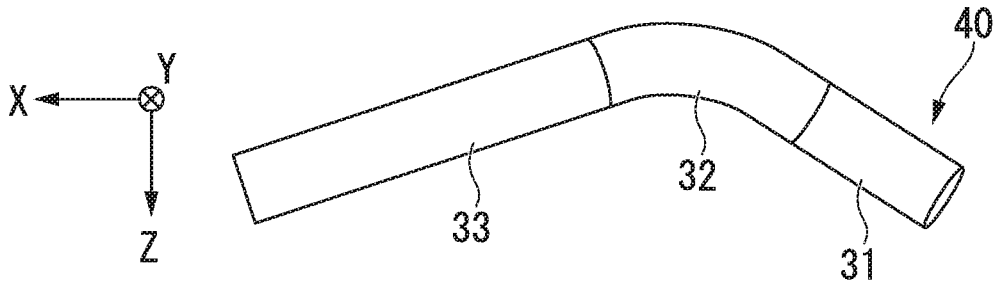
FIG. 13A is a front view showing the intermediate press-formed product after welding a joint of the intermediate press-formed product.
Figure 13B:
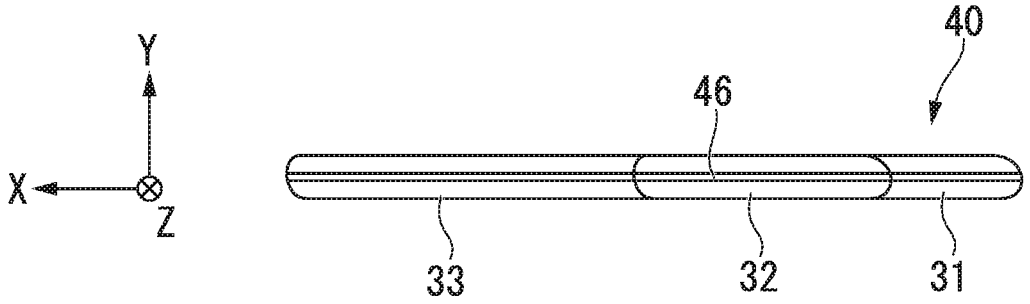
FIG. 13B is a plan view showing the intermediate press-formed product.
Figure 13C:
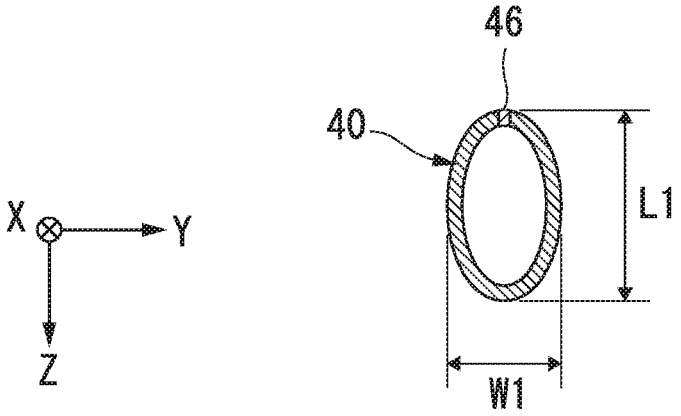
FIG. 13C is a transverse cross-sectional view showing the intermediate press-formed product.

FIG. 13A to FIG. 13C are views showing an intermediate press-formed product 40 that is obtained in the joining process S4. Furthermore, as shown in FIG. 13A to FIG. 13C, the intermediate press-formed product 40 has a hollow elliptical cross-section, and a welded portion 46 is formed at a site corresponding to the joint portion 34 (refer to FIG. 12B and FIG. 12C) of the intermediate press-formed product 30. Furthermore, in FIG. 13C, L1 represents a length (a length in a major axis direction) in the Z-direction, and W1 represents a length (length in a minor axis direction) in the Y-direction.

[Circular Forming Process S5]

In the circular forming process S5, the press-formed product 50 (refer to FIG. 2A to FIG. 2D) is manufactured by press-forming the intermediate press-formed product 40 obtained in the joining process S4 by using a circular forming die 140.

Figure 14A:
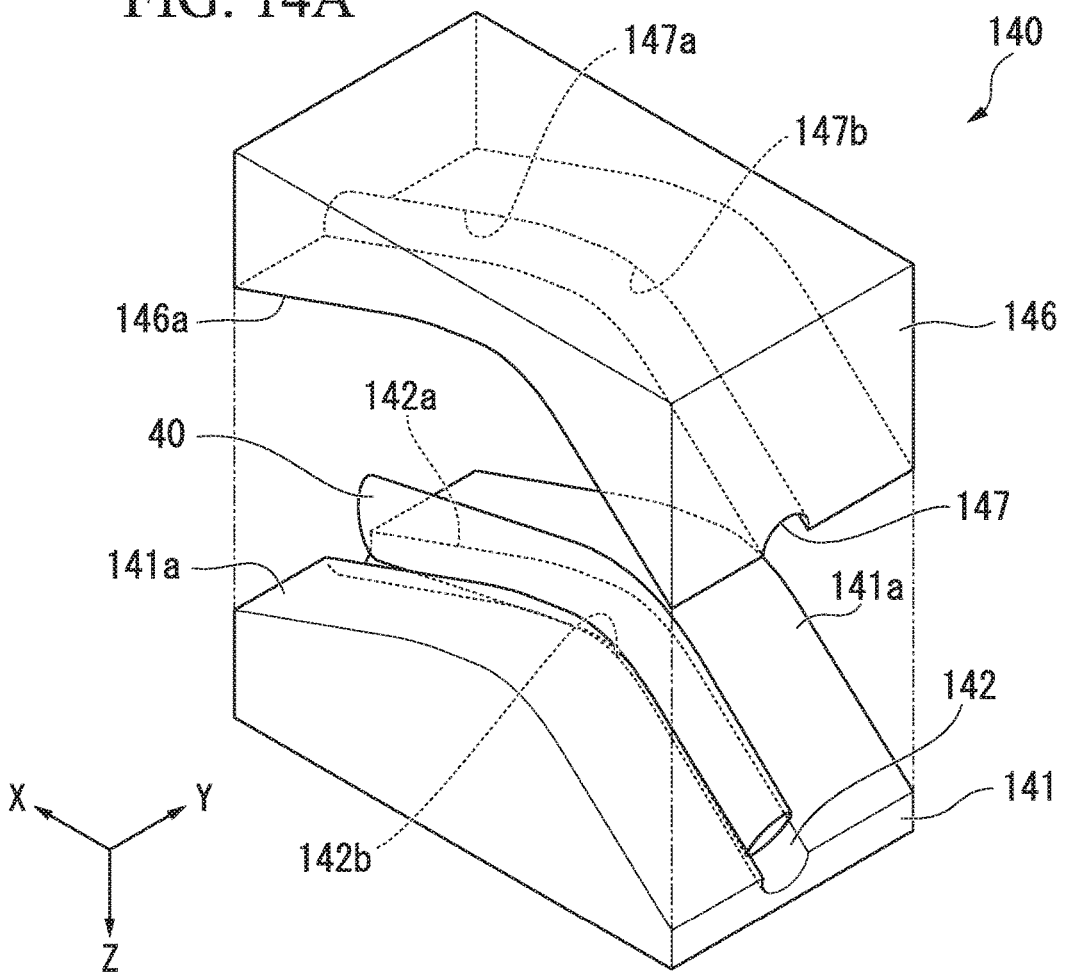
FIG. 14A is a perspective view showing a circular forming die according to the first embodiment of the invention.
Figure 14B:
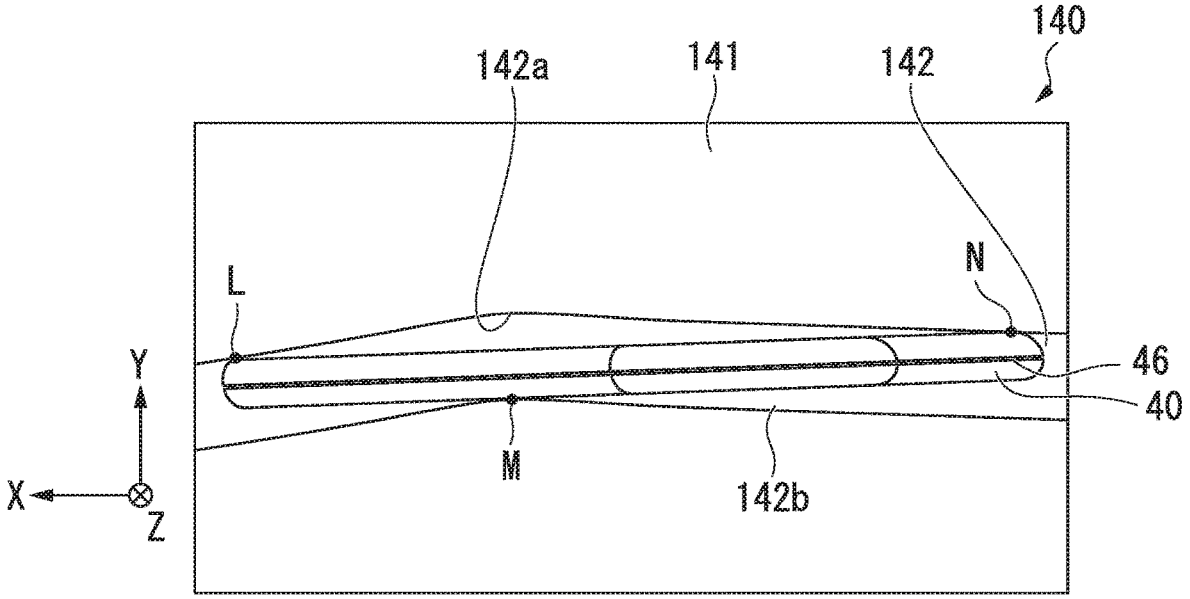
FIG. 14B is a plan view showing a lower die of the circular forming die.
Figure 14C:
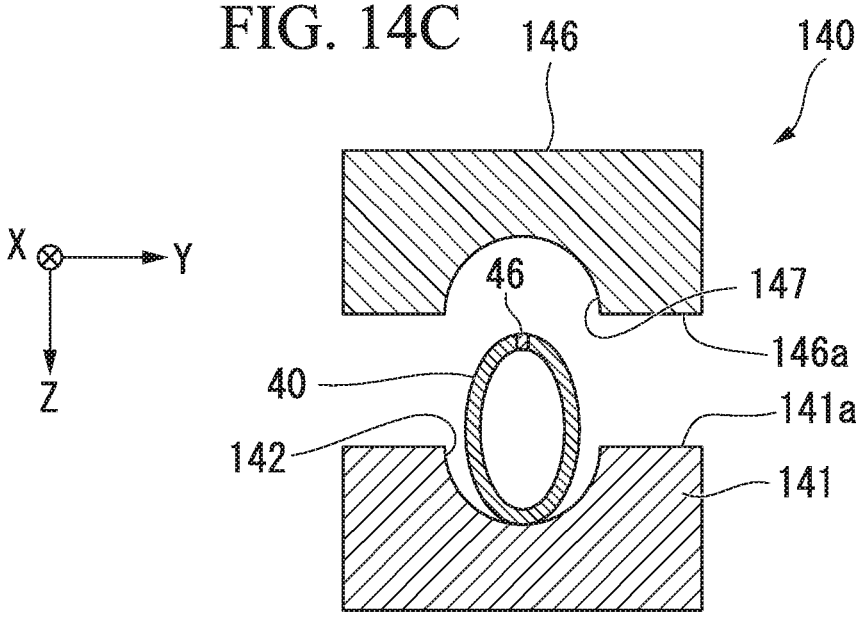
FIG. 14C is a transverse cross-sectional view showing the circular forming die.

FIG. 14A to FIG. 14C are views showing the circular forming die 140 that is used in the circular forming process S5. FIG. 14A is a perspective view of the circular forming die 140, FIG. 14B is a plan view of the circular forming die 140, and FIG. 14C is a transverse cross-sectional view of the circular forming die 140. Furthermore, an upper die 146 of the circular forming die 140 is not shown in FIG. 14B.

As shown in FIG. 14A and FIG. 14C, the circular forming die 140 includes a lower die 141 and the upper die 146 that is disposed to face the lower die 141. In the circular forming die 140, the upper die 146 is lowered along the Z-direction to press the intermediate press-formed product 40 that is placed between the lower die 141 and the upper die 146.

A concave portion 142 having a semicircular cross-section is formed in the lower die 141 of the circular forming die 140 between both ends of the lower die 141 in the X-direction. A first curved tubular portion forming section 142*b* for formation of the first curved tubular portion 52 of the press-formed product 50, and a second curved tubular portion forming section 142*a* for formation of the second curved tubular portion 54 of the press-formed product 50 are formed partway along the concave portion 142.

A concave portion 147 having a semicircular cross-section is formed in the upper die 146 of the circular forming die 140 between both ends of the upper die 146 in the X-direction to face the concave portion 142 of the lower die 141. A first curved tubular portion forming section 147*b* for formation of the first curved tubular portion 52 of the press-formed product 50, and a second curved tubular portion forming section 147*a* for formation of the second curved tubular portion 54 of the press-formed product 50 are formed partway along the concave portion 147.

Figure 15:
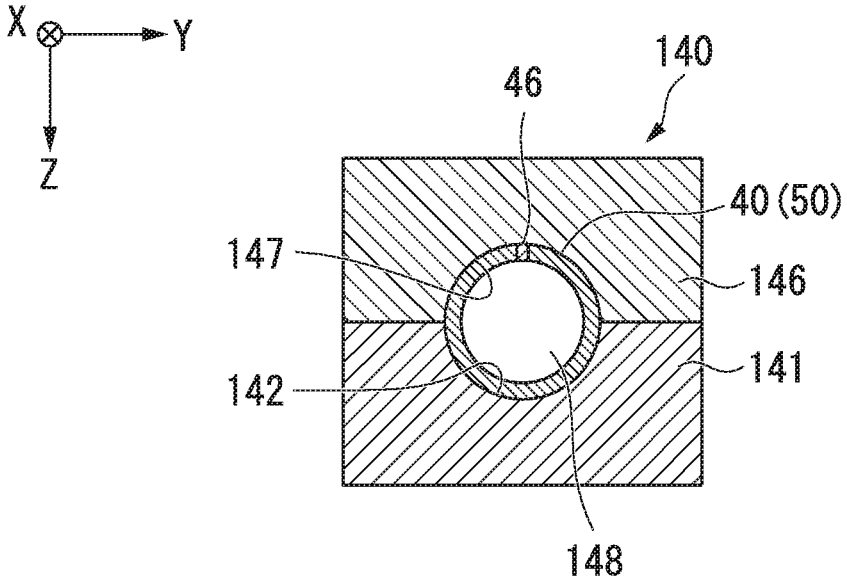
FIG. 15 is a transverse cross-sectional view showing a state in which an upper die of the circular forming die is lowered to a lower dead point.

When press-forming the intermediate press-formed product 40 by the circular forming die 140, the upper die 146 is lowered along the Z-direction until a bottom surface 146*a* of the upper die 146 comes into contact with an upper surface 141*a* of the lower die 141. In a state in which the bottom surface 146*a* of the upper die 146 comes into contact with the upper surface 141*a* of the lower die 141, a space 148 (forming space), which is surrounded by the concave portion 142 of the lower die 141 and the concave portion 147 of the upper die 146, is formed as shown in FIG. 15. This space 148 is formed in a shape conforming to an external shape of the press-formed product 50. Accordingly, it is possible to form the intermediate press-formed product 40 into the press-formed product 50 by pressing the intermediate press-formed product 40 by using the circular forming die 140.

In the circular forming process S5, first, as shown in FIG. 14A and FIG. 14C, the intermediate press-formed product 40 having an elliptical cross-section is placed in the concave portion 142 of the lower die 141 in such a manner that the major axis direction becomes parallel to the Z-direction. At this time, as shown in FIG. 14B, the intermediate press-formed product 40 approaches the concave portion 142 of the lower die at positions L, M, and N of the concave portion 142 of the lower die 141 in a plan view.

Furthermore, in this embodiment, the intermediate press-formed product 40 is placed in the concave portion 142 of the lower die 141 without applying an external force to the intermediate press-formed product 40. However, the intermediate press-formed product 40 may be placed in the concave portion 142 of the lower die 141 by applying an external force and the like to the intermediate press-formed product 40 in accordance with a shape of the intermediate press-formed product 40, a shape of the concave portion 142 of the lower die 141, and the like.

Figure 16A:
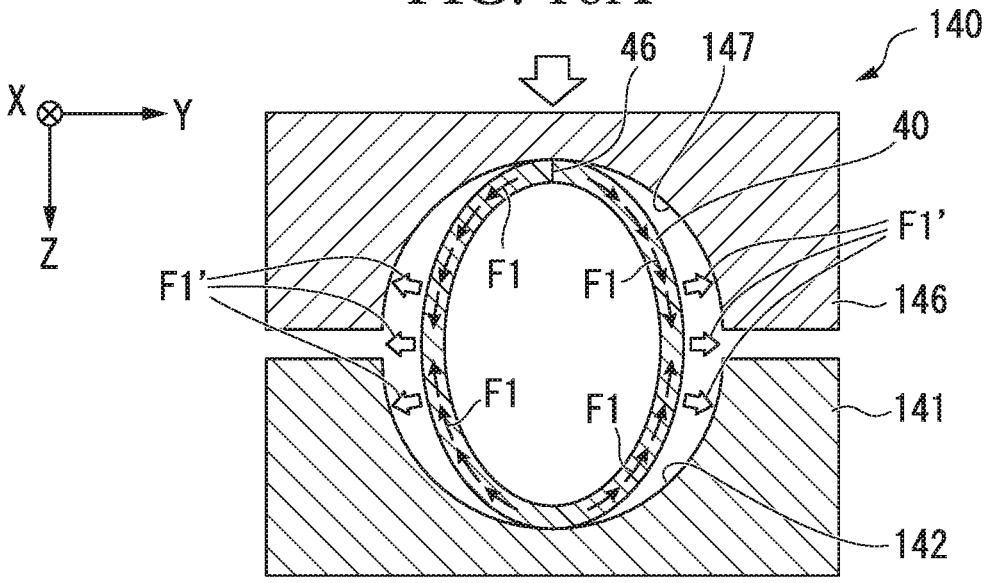
FIG. 16A is a view showing a circular forming process by using the circular forming die.

Subsequently, the upper die 146 is lowered along the Z-direction (the major axis direction of the intermediate press-formed product 40) to press-form the intermediate press-formed product 40. At this time, as shown in FIG. 16A, when the concave portion 147 of the upper die 146 comes into contact with the intermediate press-formed product 40, in the intermediate press-formed product 40, a deformation force F1' occurs toward an outer side, and a circumferential stress F1 (a compressive stress in a circumferential direction) occurs. According to this, when the upper die 146 is lowered along the Z-direction, the intermediate press-formed product 40 is compressed in the Z-direction, and is expanded in a direction intersecting the Z-direction.

Figure 16B:
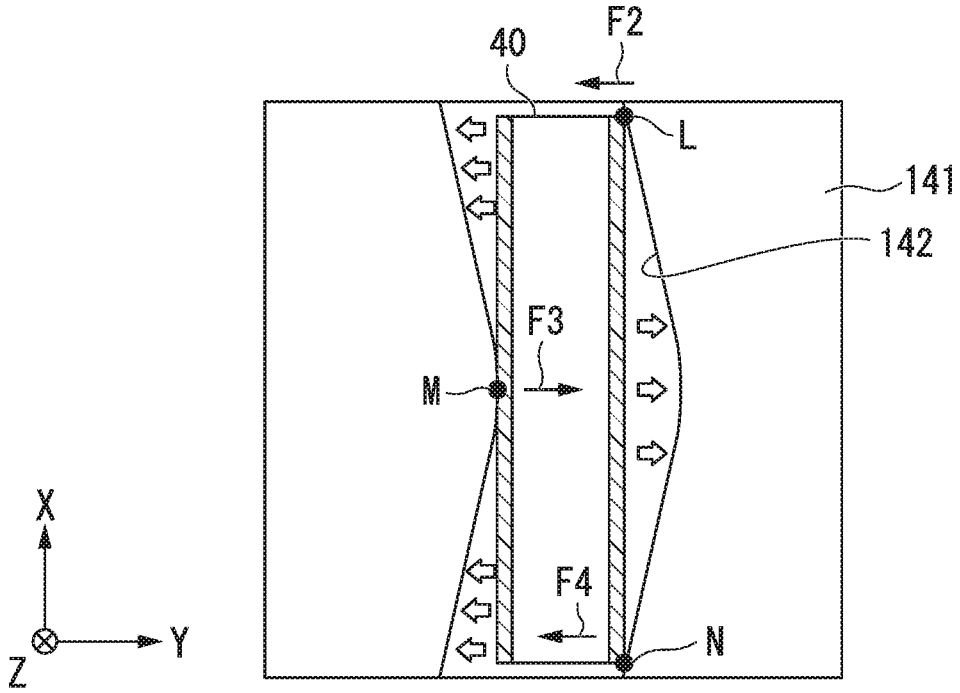
FIG. 16B is a view showing the circular forming process by using the circular forming die.

As shown in FIG. 16B, when the intermediate press-formed product 40 is expanded, an outer surface of the intermediate press-formed product 40 comes into contact with the concave portion 142 of the lower die 141 at positions L, M, and N. Accordingly, the outer surface receives reactive forces F2, F3, and F4 at the respective positions. As a result, a bending moment is applied to the intermediate press-formed product 40, and thus the intermediate press-formed product 40 is bent in the Y-direction.

Figure 16C:
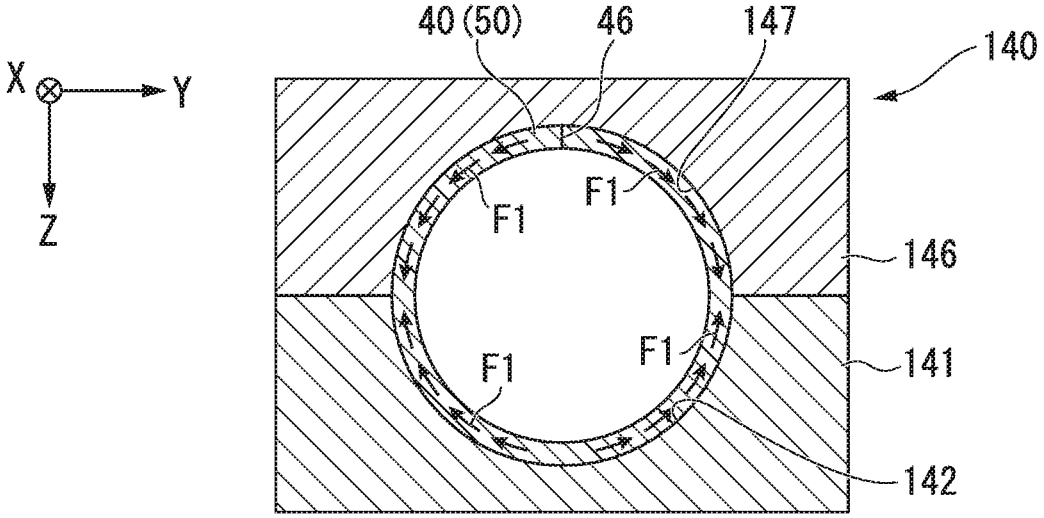
FIG. 16C is a view showing the circular forming process by using the circular forming die.

In addition, as shown in FIG. 15 and FIG. 16C, when the upper die 146 is lowered to a lower dead point, the intermediate press-formed product 40 has a shape conforming to the concave portion 142 of the lower die 141 and the concave portion 147 of the upper die 146. Accordingly, it is possible to obtain the press-formed product 50. In this manner, the circular forming process S5 is completed.

As described above, in the circular forming process S5, the intermediate press-formed product 40 having an elliptical cross-section is compressed by pressing the intermediate press-formed product 40 in the major axis direction. Accordingly, the length L1 (length in the Z-direction: refer to FIG. 13C) in the major axis direction of the intermediate press-formed product 40 decreases. On the other hand, the length W1 of the intermediate press-formed product 40 in the minor axis direction increases. As a result, it is possible to obtain the press-formed product 50 having a circular cross-section.

In addition, as shown in FIG. 16C, a residual stress along the circumferential direction is formed in the intermediate press-formed product 40 (that is, in the press-formed product 50) after the circular forming process S5 due to the circumferential stress F1 (compressive stress in the circumferential direction). Accordingly, it is possible to enhance the strength of the press-formed product 50. Similarly, a residual stress is also formed in the welded portion 56 of the press-formed product 50. Accordingly, it is possible to enhance the strength of the welded portion 56.

Figure 17:
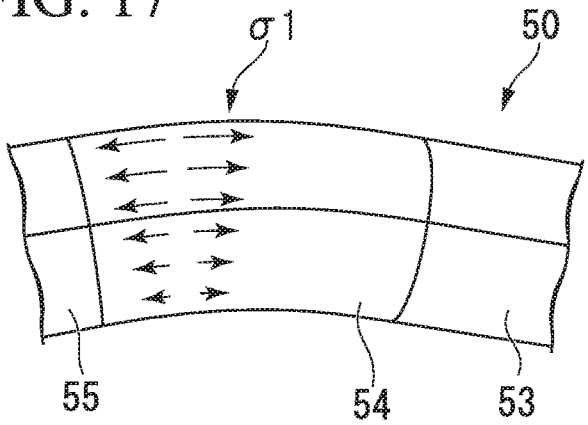
FIG. 17 is an enlarged view of a portion indicated by a symbol B in FIG. 2B, and is a view showing a residual stress that occurs in the press-formed product.

In addition, in the press-formed product 50, as shown in FIG. 17, a residual stress σ1 is formed in the second curved tubular portion 54 along the X-direction. For example, the residual stress σ1 is a residual tensile stress, and a residual tensile stress that occurs on an outer side (large curvature-of-radius side) of the second curved tubular portion 54 is greater than a residual tensile stress that occurs on an inner side (small curvature-of-radius side) of the second curved tubular portion 54. Furthermore, the residual stress σ1 that is formed in the second curved tubular portion 54 varies in accordance with a radius of curvature (or bending degree). The residual tensile stress may not be formed on the inner side of the second curved tubular portion 54, or the residual compressive stress may be formed on the inner side of the second curved tubular portion 54.

Figure 18:
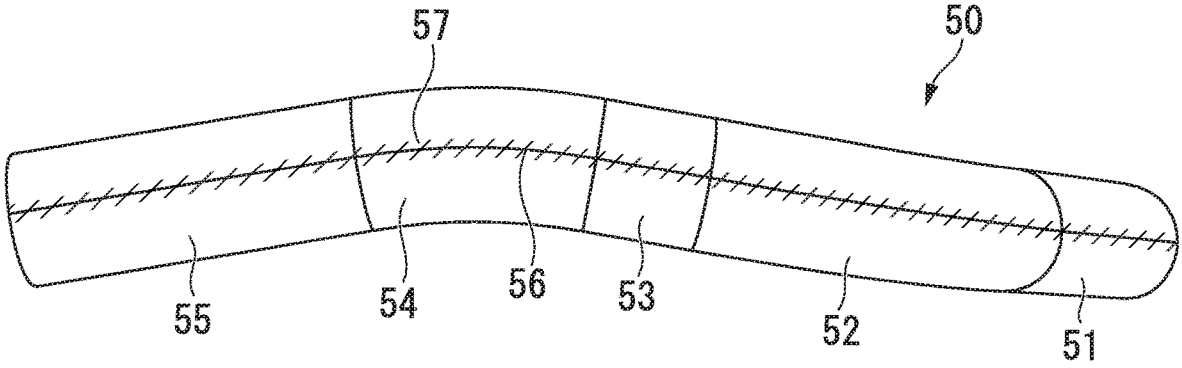
FIG. 18 is a plan view showing a state in which a press trace is formed in the press-formed product.

In addition, in the press-formed product 50, as shown in FIG. 18, it is preferable that a press trace 57 is formed at a portion, which is perpendicular to a press direction (Z-direction), on outer surfaces of the straight tubular portions 51, 53, and 55, the first curved tubular portion 52, and the second curved tubular portion 54. In this case, it is possible to easily detect a forming defect such as a depression by identifying whether or not the press trace 57 is formed, and thus it is possible to efficiently perform a quality management.

Figure 19:
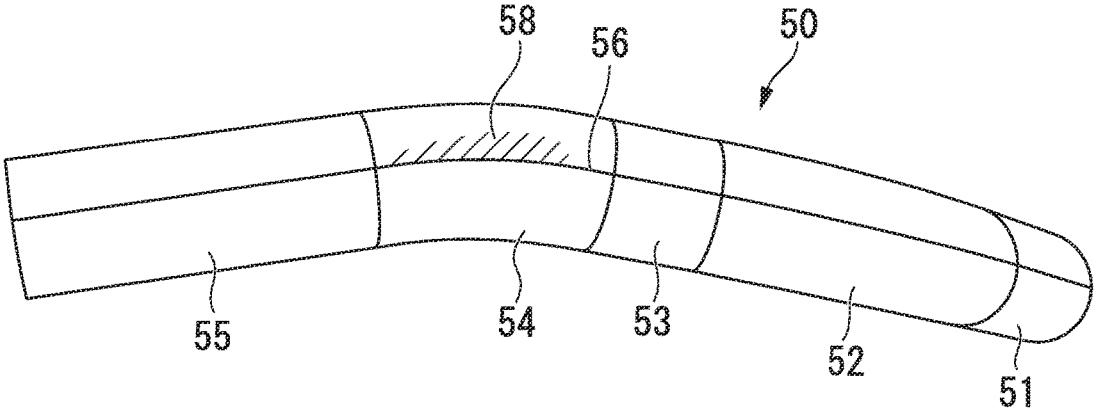
FIG. 19 is a plan view showing a state in which a sliding trace is formed in the press-formed product.

In addition, in the press-formed product 50, as shown in FIG. 19, it is preferable that a sliding trace 58 is formed at a portion, which is perpendicular to the press direction (Z-direction), on the outer surface of the second curved tubular portion 54. In this case, it is possible to easily detect a forming defect such as a depression by identifying whether or not the sliding trace 58 is formed, and thus it is possible to efficiently perform a quality management. Furthermore, the sliding trace 58 may be formed at a portion, which is perpendicular to the press direction (Z-direction), on the outer surfaces of the straight tubular portions 51, 53, and 55, the first curved tubular portion 52, and the second curved tubular portion 54.

As described above, in the method of manufacturing the press-formed product according to this embodiment, after the U-bending forming process S1, the excess metal 14 of the intermediate press-formed product 10 is removed through trimming. According to this, in the elliptical forming process S3, it is possible to allow the edges 24*a* of the intermediate press-formed product 20 obtained in the trimming process S2 to come into contact with each other in an easy and accurate manner.

In addition, after the elliptical forming process S3, the intermediate press-formed product 30 obtained in the elliptical forming process S3 is joined (welded). Accordingly, in the circular forming process S5, ends is suppressed from being spaced away from each other, and thus it is possible to stably manufacture the press-formed product 50. In addition, in the circular forming process S5, the welded portion 46 of the intermediate press-formed product 40 is compressed, and thus the residual stress is formed in the welded portion 46. According to this, it is possible to enhance the strength of the welded portion 56 of the press-formed product 50.

Accordingly, the sequence of the joining process S4 and the circular forming process S5 may be reversed, but it is preferable to perform the circular forming process S5 after the joining process S4 in consideration of the above-described reason.

In addition, in the circular forming process S5, since the intermediate press-formed product 40 having an elliptical cross-section is pressed along the major axis direction, it is possible to expand the intermediate press-formed product 40 in a direction intersecting the major axis direction. In addition, the intermediate press-formed product 40 is bent by using a force that occurs due to the expansion, and thus it is possible to prevent a defect such as a depression from occurring in the press-formed product 50.

Furthermore, it is preferable that a ratio between the length L1 (length in the major axis direction) and W1 (length in the minor axis direction) of the intermediate press-formed product 40 (refer to FIG. 13C) obtained in the joining process S4 is 1.1≤L1/W1≤5.0. When L1/W1 is set to 5.0 or less, it is possible to prevent wrinkles from occurring in the flat plate 1 in the U-bending forming process S1. In addition, when L1/W1 is set to 1.1 or greater, in the circular forming process S5, it is possible to expand the intermediate press-formed product 40 with a small load, and thus it is possible to reduce a press load.

[Modification Example of First Embodiment]

In this embodiment, a description will be provided of a case where the intermediate press-formed product 40 is press-formed by using the circular forming die 140 in the circular forming process S5. However, the intermediate press-formed product 40 may be press-formed in stages (in a plurality of times) by using a circular forming die 160 shown in FIG. 20A and a circular forming die 170 shown in FIG. 20B.

Figure 20A:
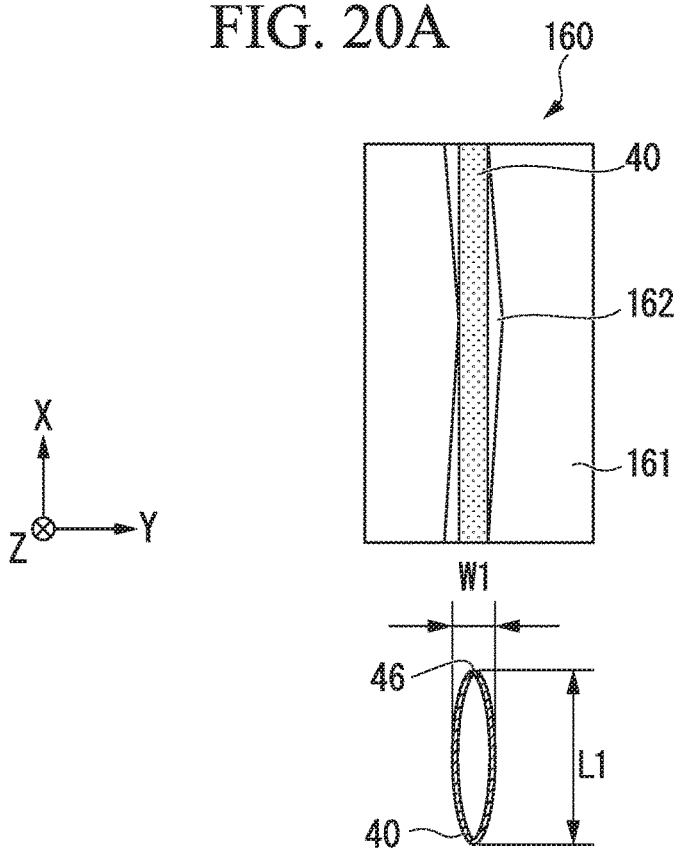
FIG. 20A is a schematic view showing a modification example of the circular forming die.

As shown in FIG. 20A, a width of a concave portion 162 of a lower die 161 of the circular forming die 160 is smaller than the width of the concave portion 142 of the lower die 141 of the circular forming die 140, and a depth thereof is greater than the depth of the concave portion 142.

Figure 20B:
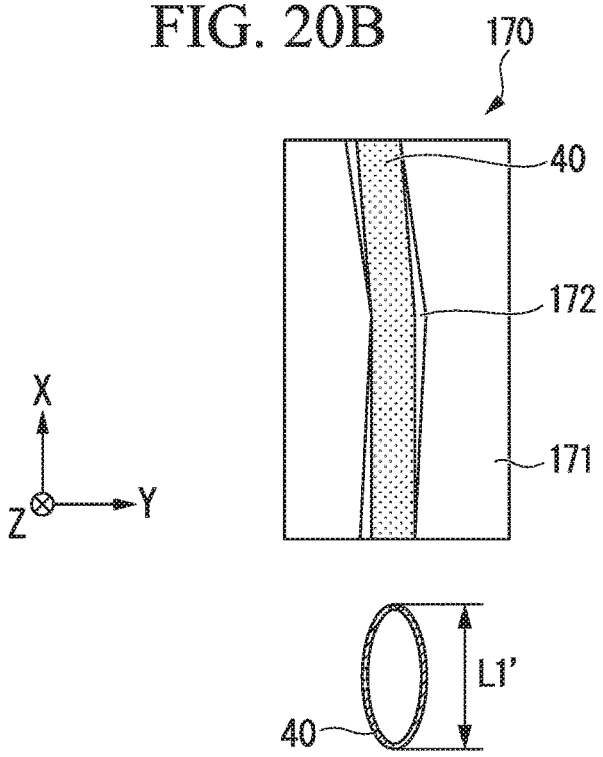
FIG. 20B is a schematic view showing the modification example of the circular forming die.

In addition, as shown in FIG. 20B, a width of the concave portion 172 of the lower die 171 of the circular forming die 170 is greater than the width of the concave portion 162 of the lower die 161 of the circular forming die 160, and a depth thereof is smaller than the depth of the concave portion 162. In addition, the width of the concave portion 172 of the lower die 171 of the circular forming die 170 is smaller than the width of the concave portion 142 of the lower die 141 of the circular forming die 140, and the depth thereof is greater than the depth of the concave portion 142.

Figure 20C:
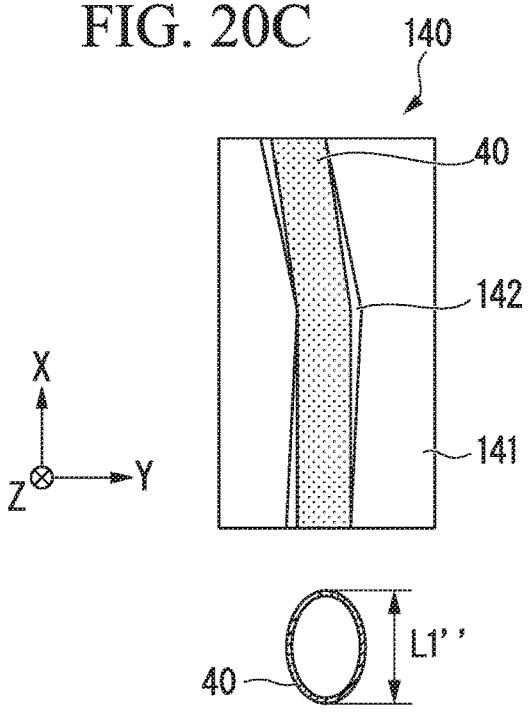
FIG. 20C is a schematic view showing the modification example of the circular forming die.
Figure 20D:
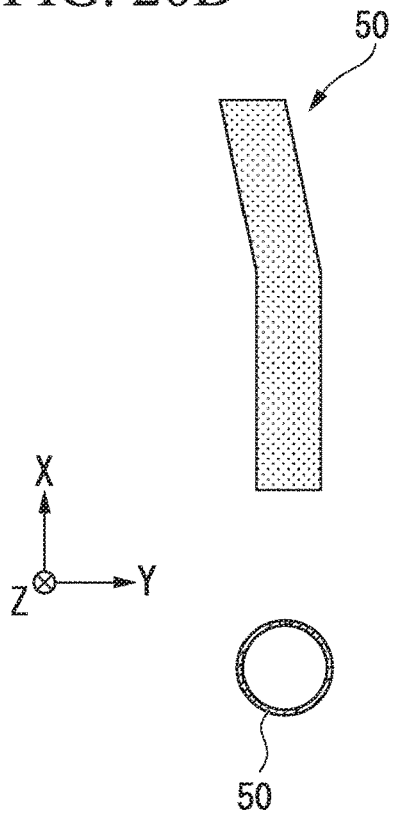
FIG. 20D is a schematic view showing a press-formed product that is obtained by the circular forming die shown in FIG. 20A to FIG. 20C.

In addition, as shown in FIG. 20A to FIG. 20C, the intermediate press-formed product 40 is press-formed by the circular forming die 160, is subsequently press-formed by the circular forming die 170, and is finally press-formed by the circular forming die 140, thereby obtaining a press-formed product 50 shown in FIG. 20D. In this case, the intermediate press-formed product 40 can be sequentially deformed, and thus it is possible to more reliably limit the occurrence of forming a defect in the press-formed product 50.

In addition, in this embodiment, a description has been provided of a case of manufacturing the press-formed product 50 having a circular cross-section from the flat plate 1. However, it is possible to manufacture a press-formed product having various cross-sectional shapes without limitation to the press-formed product 50 having a circular cross-section.

Figure 21A:
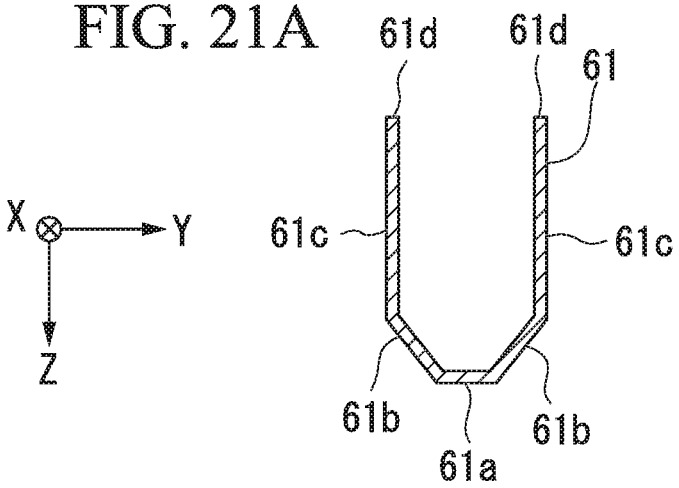
FIG. 21A is a view showing a first modification example of the press-formed product.
Figure 21B:
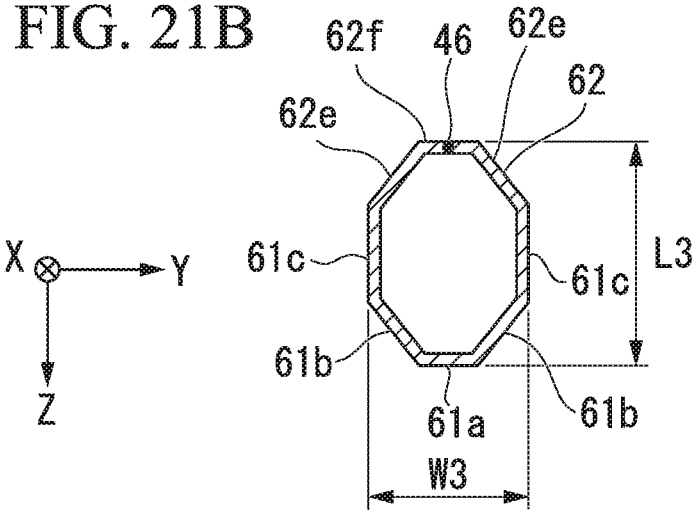
FIG. 21B is a view showing the first modification example of the press-formed product.
Figure 21C:
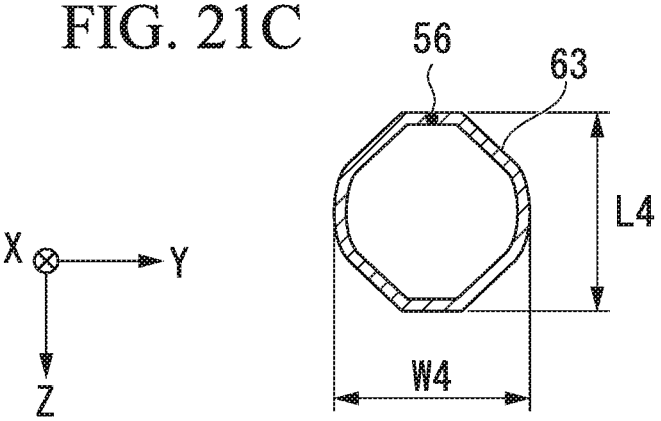
FIG. 21C is a view showing the first modification example of the press-formed product.

FIG. 21C is a cross-sectional view showing a press-formed product 63. As shown in FIG. 21C, the press-formed product 63 has an approximately octagonal cross-sectional shape. The press-formed product 63 is manufactured in the following procedure.

First, the flat plate 1 is formed into an intermediate press-formed product 61 shown in FIG. 21A in the same manner as in the U-bending forming process S1. The intermediate press-formed product 61 includes a bottom wall portion 61*a* that extends in the Y-direction, a pair of first side wall portions 61*b* between which a distance increases as it goes to an upward side in the Z-direction from both ends of the bottom wall portion 61*a*, and a pair of second side wall portions 61*c* which are provided on upper ends of the first side wall portions 61*b*, face to each other, and are parallel to the Z-direction.

Subsequently, end surfaces 61*d* of the intermediate press-formed product 61 are butted against each other in the same manner as in the elliptical forming process S3. Then, the intermediate press-formed product 61 is welded in the same manner as in the joining process S4 to obtain an intermediate press-formed product 62 shown in FIG. 21B. As shown in FIG. 21B, the intermediate press-formed product 62 is different from the intermediate press-formed product 61 in that the intermediate press-formed product 62 is provided with a pair of third side wall portions 62*e* between which a distance decreases as it goes to an upward side in the Z-direction, and an upper wall portion 62*f* that is provided between the pair of third side wall portions 62*e* and faces the bottom wall portion 61*a*, and a welded portion 46.

Then, the intermediate press-formed product 62 is pressed in the Z-direction (long cross-sectional direction) in the same manner as in the circular forming process S5 to obtain a press-formed product 63 shown in FIG. 21C. Furthermore, at this time, as is the case with the first embodiment, the intermediate press-formed product 62 is compressed in the Z-direction, and is expanded in a direction intersecting the Z-direction. According to this, in the press-formed product 63, a ratio (=L4/W4) of a dimension L4 in the Z-direction to a dimension W4 in the Y-direction is set to be smaller than a ratio (=L3/W3) of a dimension L3 in the Z-direction to a dimension W3 in the Y-direction in the intermediate press-formed product 62.

Figure 22A:
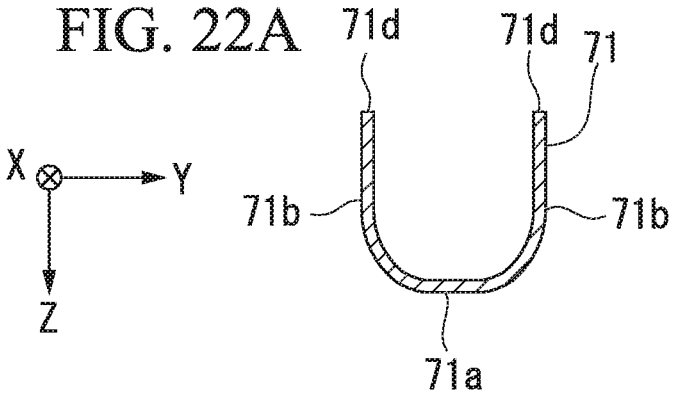
FIG. 22A is a view showing a second modification example of the press-formed product.
Figure 22B:
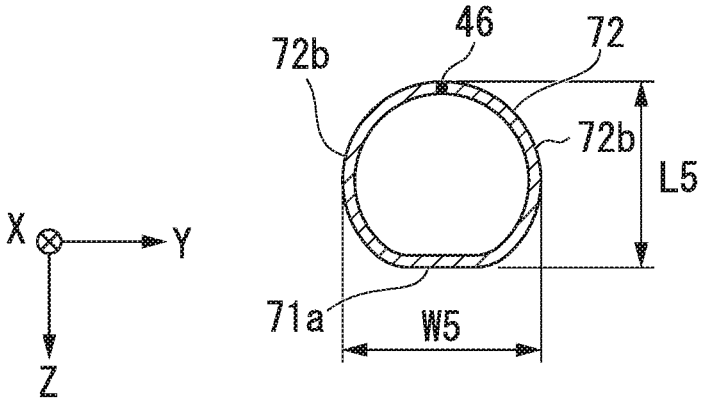
FIG. 22B is a view showing the second modification example of the press-formed product.
Figure 22C:
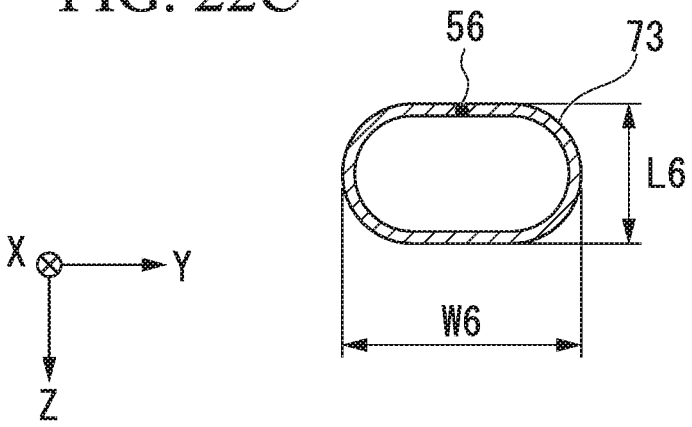
FIG. 22C is a view showing the second modification example of the press-formed product.

In addition, a press-formed product 73 having an elliptical cross-section that is long in a horizontal direction as shown in FIG. 22C can be manufactured from the flat plate 1. The press-formed product 73 is manufactured in the following procedure.

First, the flat plate 1 is formed into an intermediate press-formed product 71 shown in FIG. 22A in the same manner as in the U-bending forming process S1. The intermediate press-formed product 71 includes a bottom wall portion 71*a*, and a pair of side wall portions 71*b* which are provided in both ends of the bottom wall portion 71*a*, face each other, and are parallel to each other in the Z-direction.

Subsequently, end surfaces 71*d* of the intermediate press-formed product 71 are butted against each other and are welded in the same manner as in the elliptical forming process S3 and the joining process S4. An intermediate press-formed product 72, which is obtained in this manner, is shown in FIG. 22B. The intermediate press-formed product 72 is different from the intermediate press-formed product 71 in that the intermediate press-formed product 72 is provided with a circular arc-shaped side wall portion 72*b* and a welded portion 46.

Then, the intermediate press-formed product 72 is pressed in the Z-direction in the same manner as in the circular forming process S5, thereby obtaining the press-formed product 73. Furthermore, as is the case with the first embodiment, the intermediate press-formed product 72 is compressed in the Z-direction and is expanded in a direction intersecting the Z-direction. According to this, in the press-formed product 73, a ratio (=L6/W6) of a dimension L6 in the Z-direction to a dimension W6 in the Y-direction is set to be smaller than a ratio (=L5/W5) of a dimension L5 in the Z-direction to a dimension W5 in the Y-direction in the intermediate press-formed product 72.

Figure 23A:
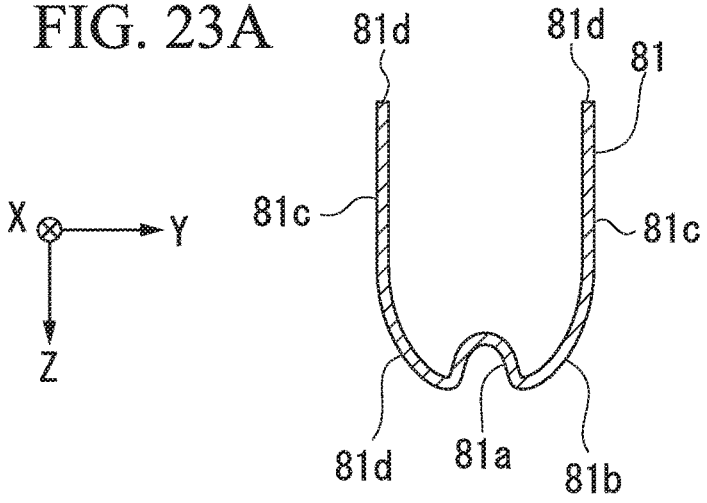
FIG. 23A is a view showing a third modification example of the press-formed product.
Figure 23B:
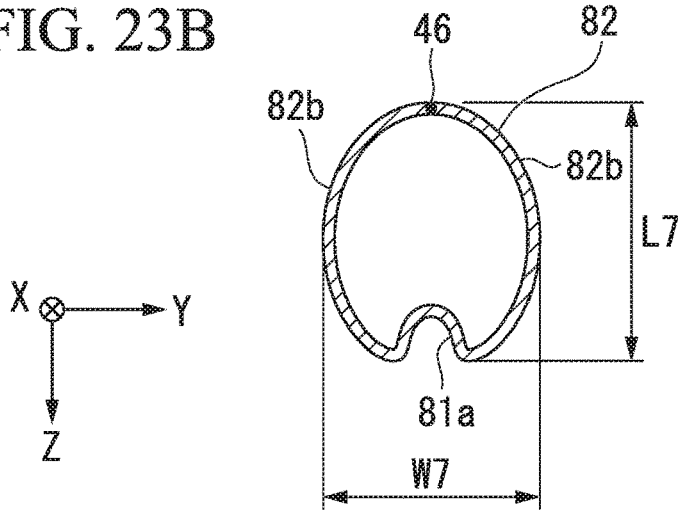
FIG. 23B is a view showing the third modification example of the press-formed product.
Figure 23C:
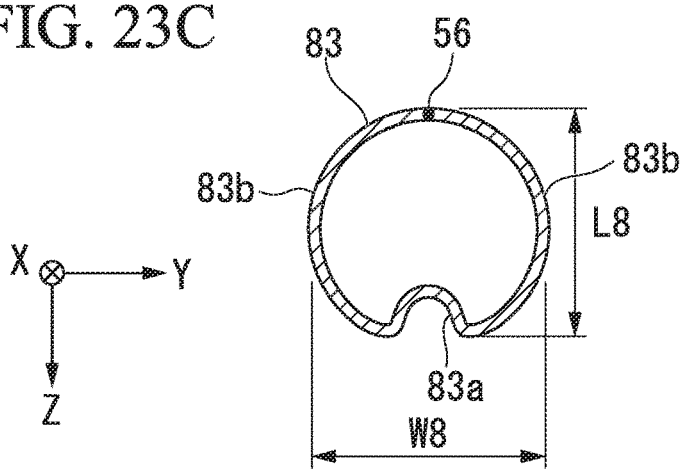
FIG. 23C is a view showing the third modification example of the press-formed product.

In addition, a press-formed product 83 shown in FIG. 23C can be manufactured from the flat plate 1. The press-formed product 83 includes a circular arc-shaped side wall portion 83*b*, and a bottom wall portion 83*a* that is curved in a convex shape toward an upward side in the Z-direction. The press-formed product 83 is manufactured in the following procedure.

First, the flat plate 1 is press-formed into an intermediate press-formed product 81 shown in FIG. 23A in the same manner as in the U-bending forming process S1. The intermediate press-formed product 81 includes a bottom wall portion 81*a* that is curved in a convex shape toward an upward side in the Z-direction, a circular arc-shaped first side wall portion 81*b* that is provided on both ends of the bottom wall portion 81*a*, and a pair of second side wall portions 81*c* which are provided in the ends of the first side wall portion 81*b*, face each other, and are parallel to each other in the Z-direction.

Subsequently, end surfaces 81*d* of the intermediate press-formed product 81 are butted against each other and are welded in the same manner as in the elliptical forming process S3 and the joining process S4. FIG. 23B shows an intermediate press-formed product 82 that is obtained as described above. Furthermore, the intermediate press-formed product 82 is different from the intermediate press-formed product 81 in that the intermediate press-formed product 82 is provided with an elliptical arc-shaped side wall portion 82*b* and a welded portion 46.

Then, the intermediate press-formed product 82 is pressed in the Z-direction in the same manner as in the circular forming process S5, thereby obtaining the press-formed product 83. Furthermore, at this time, as is the case with the first embodiment, the intermediate press-formed product 82 is compressed in the Z-direction and is expanded in a direction interesting the Z-direction. According to this, in the press-formed product 83, a ratio (=L8/W8) of a dimension L8 in the Z-direction to a dimension W8 in the Y-direction is set to be smaller than a ratio (=L7/W7) of a dimension L7 in the Z-direction to a dimension W7 in the Y-direction in the intermediate press-formed product 82.

Second Embodiment

Next, a description will be provided of a second embodiment of the invention.

Figure 24:
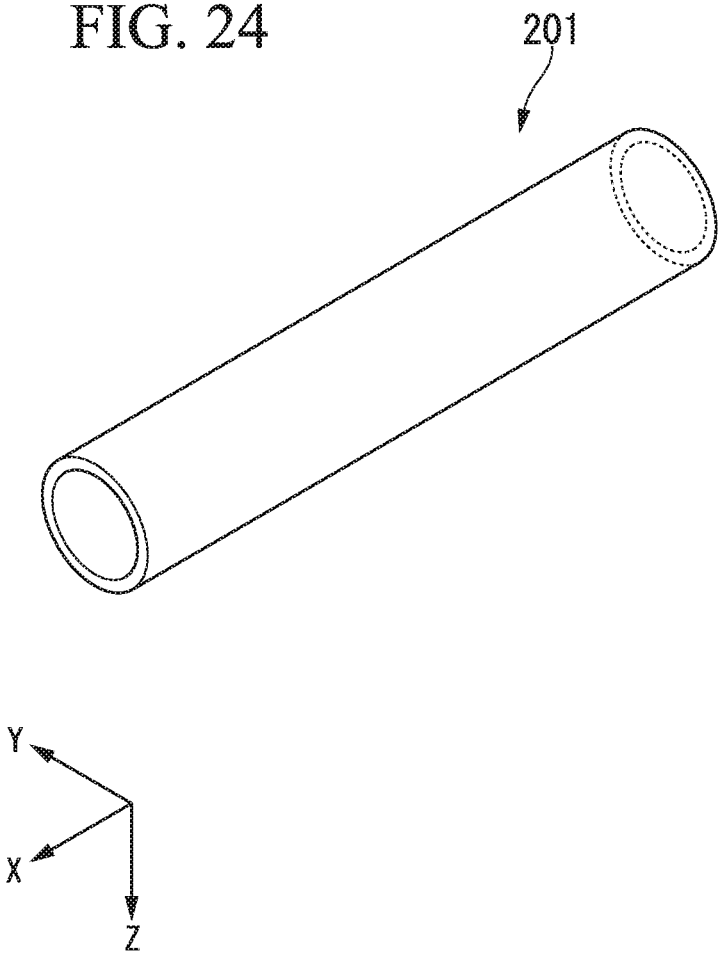
FIG. 24 is a perspective view showing a cylindrical tube that is used in a method of manufacturing a press-formed product according to a second embodiment of the invention.

In the first embodiment, a description has been provided of a case of manufacturing the press-formed product 50 from the flat plate 1. In contrast, in this embodiment, a press-formed product 250 is manufactured from a cylindrical tube 201 shown in FIG. 24.

For example, a material of the cylindrical tube 201 is a metal such as iron, aluminum, stainless steel, copper, titanium, magnesium, and steel. In addition, examples of the cylindrical tube 201 include a pipe manufactured through extrusion forming, a pipe manufactured through drawing forming, an electric resistance welded tube, and the like. In addition, it is preferable that the thickness (wall thickness) of the cylindrical tube 201 is 0.5 to 10.0 mm, and more preferably 1.0 to 3.2 mm.

Figure 25A:
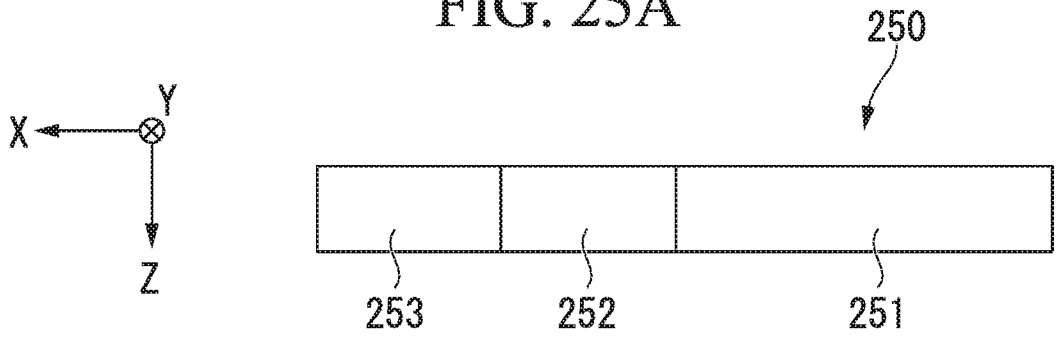
FIG. 25A is a front view showing the press-formed product according to the second embodiment of the invention.
Figure 25B:
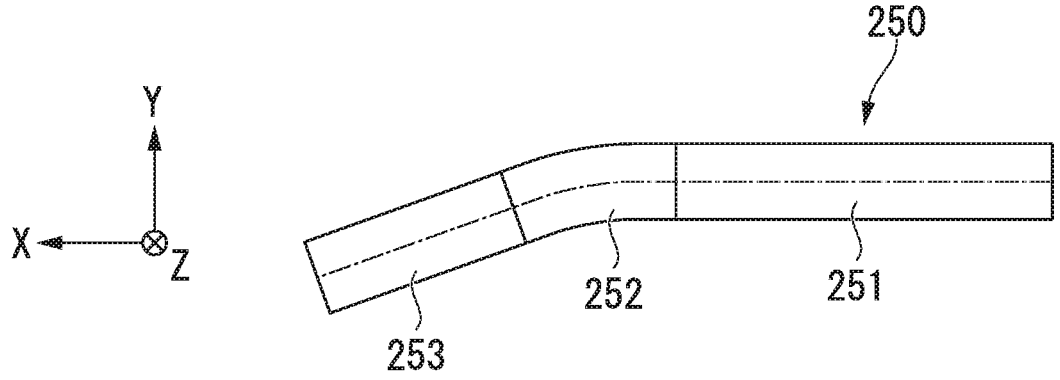
FIG. 25B is a plan view showing the press-formed product.
Figure 25C:
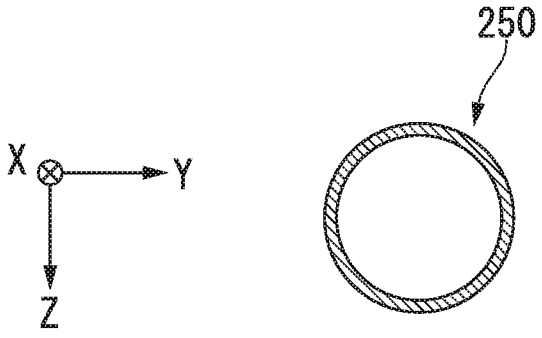
FIG. 25C is a transverse cross-sectional view showing the press-formed product.

FIG. 25A to FIG. 25C are views showing the press-formed product 250 according to this embodiment. Furthermore, FIG. 25A is a front view of the press-formed product 250, FIG. 25B is a plan view of the press-formed product 250, and FIG. 25C is a transverse cross-sectional view of the press-formed product 250.

As shown in FIG. 25A to FIG. 25C, the press-formed product 250 has a cylindrical shape that is long in the X-direction, and includes two straight tubular portion 251 and 253, and a curved tubular portion 252 (bent portion) that is provided therebetween. Furthermore, as shown in FIG. 25B, the curved tubular portion 252 of the press-formed product 250 is curved in a plane including the X-direction and the Y-direction.

Figure 26:
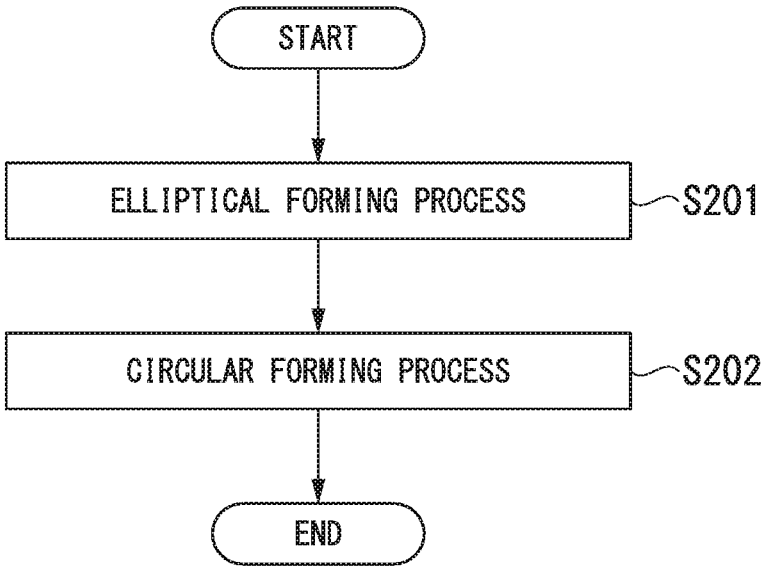
FIG. 26 is a flowchart showing the method of manufacturing the press-formed product according to the second embodiment of the invention.

Next, a description will be provided of a method of manufacturing the press-formed product 250 according to this embodiment. FIG. 26 is a flowchart showing the method of manufacturing the press-formed product 250 according to this embodiment.

As shown in FIG. 26, the method of manufacturing the press-formed product 250 includes an elliptical forming process S201, and a circular forming process S202. Furthermore, the processes are performed in a hot state or a cold state.

Figure 27A:
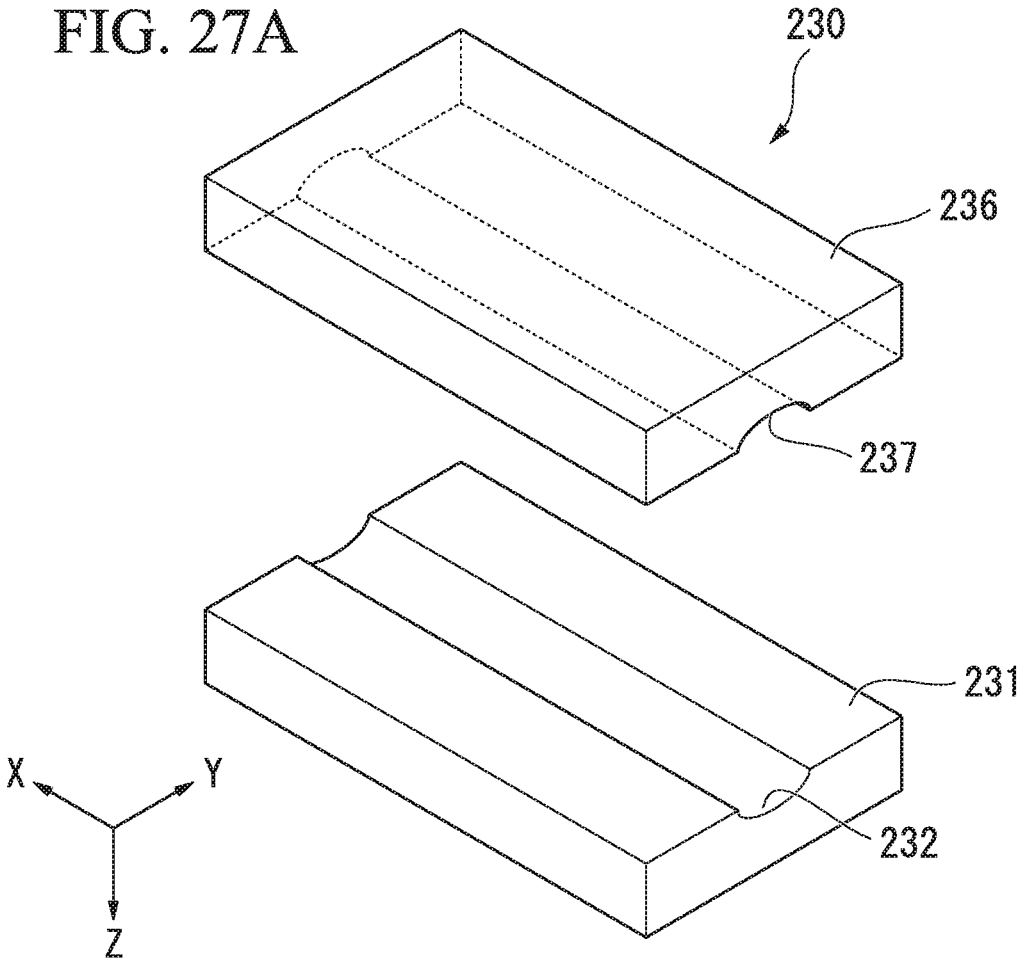
FIG. 27A is a perspective view showing an elliptical forming die according to the second embodiment of the invention.
Figure 27B:
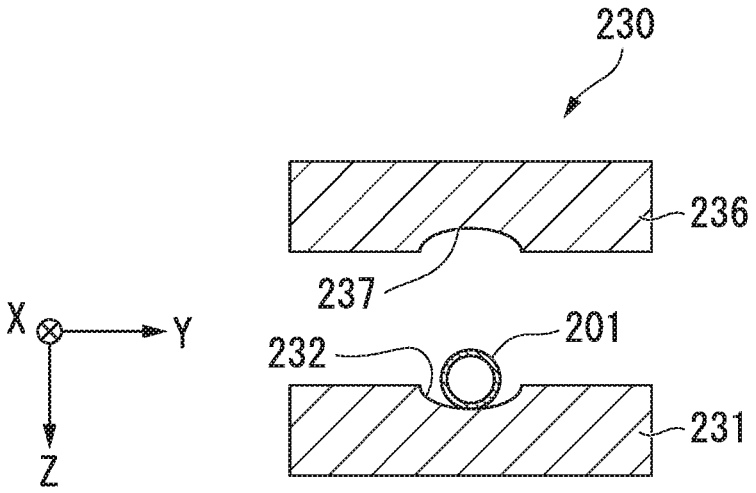
FIG. 27B is a transverse cross-sectional view showing the elliptical forming die.
Figure 28:
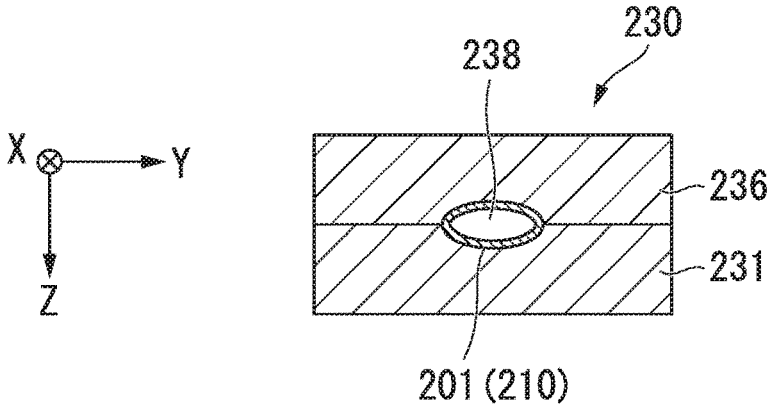
FIG. 28 is a transverse cross-sectional view showing a state in which an upper die of the elliptical forming die is lowered to a lower dead point.

In the elliptical forming process S201, the cylindrical tube 201 is press-formed into an intermediate press-formed product 210 having an elliptical cross-section as shown in FIG. 28 by using an elliptical forming die 230 shown in FIG. 27A and FIG. 27B. Furthermore, FIG. 27A is a perspective view of the elliptical forming die 230 (the cylindrical tube 201 is not shown), and FIG. 27B is a transverse cross-sectional view of the elliptical forming die 230.

As shown in FIG. 27A and FIG. 27B, the elliptical forming die 230 includes a lower die 231 and an upper die 236 that is disposed to face the lower die 231. A concave portion 232, which linearly extends along the X-direction, is formed in the lower die 231 of the elliptical forming die 230. In addition, a concave portion 237, which faces the concave portion 232 of the lower die 231, is formed in the upper die 236 of the elliptical forming die 230. In addition, in a state in which the upper die 236 is lowered in the Z-direction in order for the upper die 236 to come into contact with the lower die 231, as shown in FIG. 28, an elliptical space 238 (forming space) is formed by the concave portion 232 of the lower die 231 and the concave portion 237 of the upper die 236.

In the elliptical forming process S201, first, as shown in FIG. 27B, the cylindrical tube 201 is placed on the concave portion 232 of the lower die 231. Then, as shown in FIG. 28, the upper die 236 is lowered along the Z-direction until a bottom surface of the upper die 236 comes into contact with an upper surface of the lower die 231. At this time, the concave portion 237 of the upper die 236 and an outer surface of the cylindrical tube 201 come into contact with each other, and thus the cylindrical tube 201 is formed into a shape conforming to the concave portion 232 of the lower die 231 and the concave portion 237 of the upper die 236. In addition, when the upper die 236 is lowered until the bottom surface of the upper die 236 comes into contact with the upper surface of the lower die 231, the intermediate press-formed product 210 having an elliptical cross-section is obtained from the cylindrical tube 201. In this manner, the elliptical forming process S201 is completed.

In the circular forming process S202, the intermediate press-formed product 210 obtained in the elliptical forming process S201 is pressed by using a circular forming die 240, thereby manufacturing the press-formed product 250.

Figure 29A:
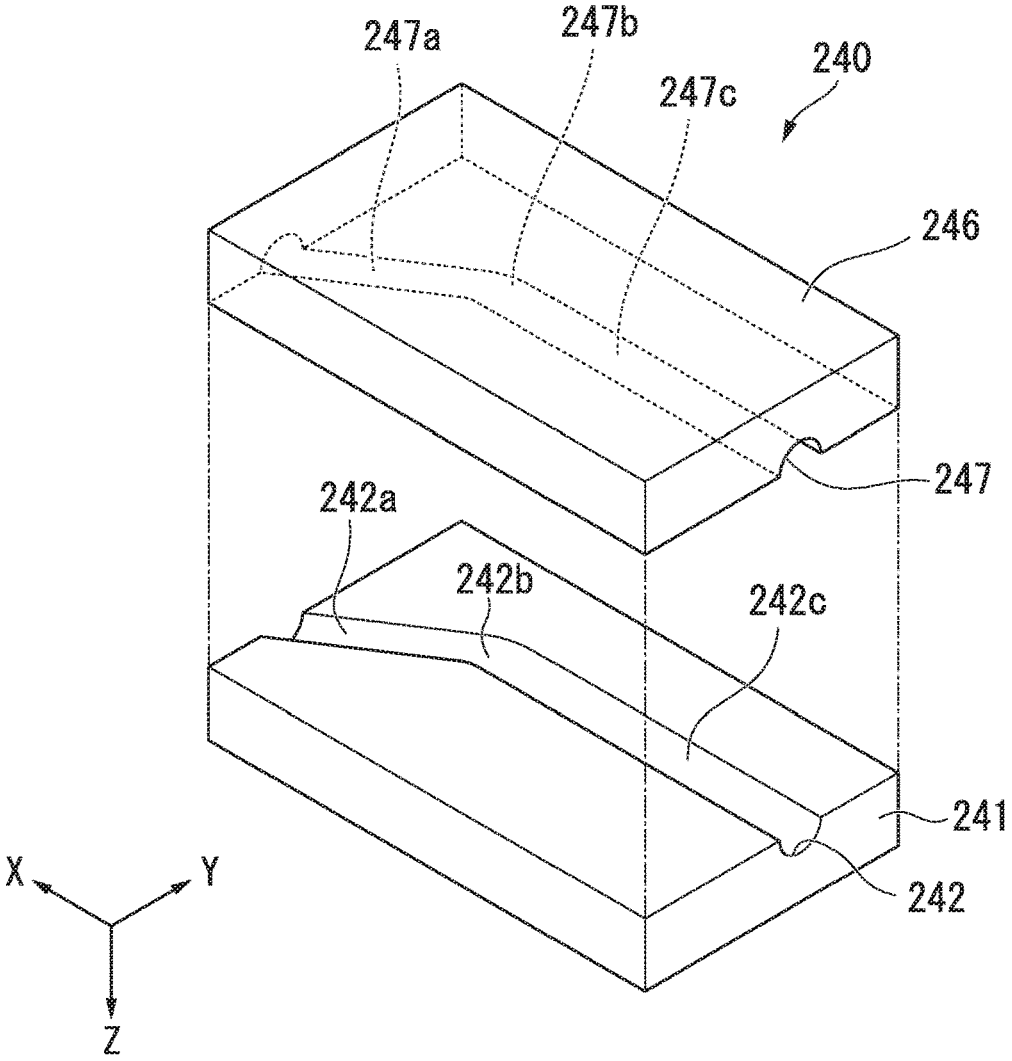
FIG. 29A is a perspective view showing a circular forming die according to the second embodiment of the invention.
Figure 29B:
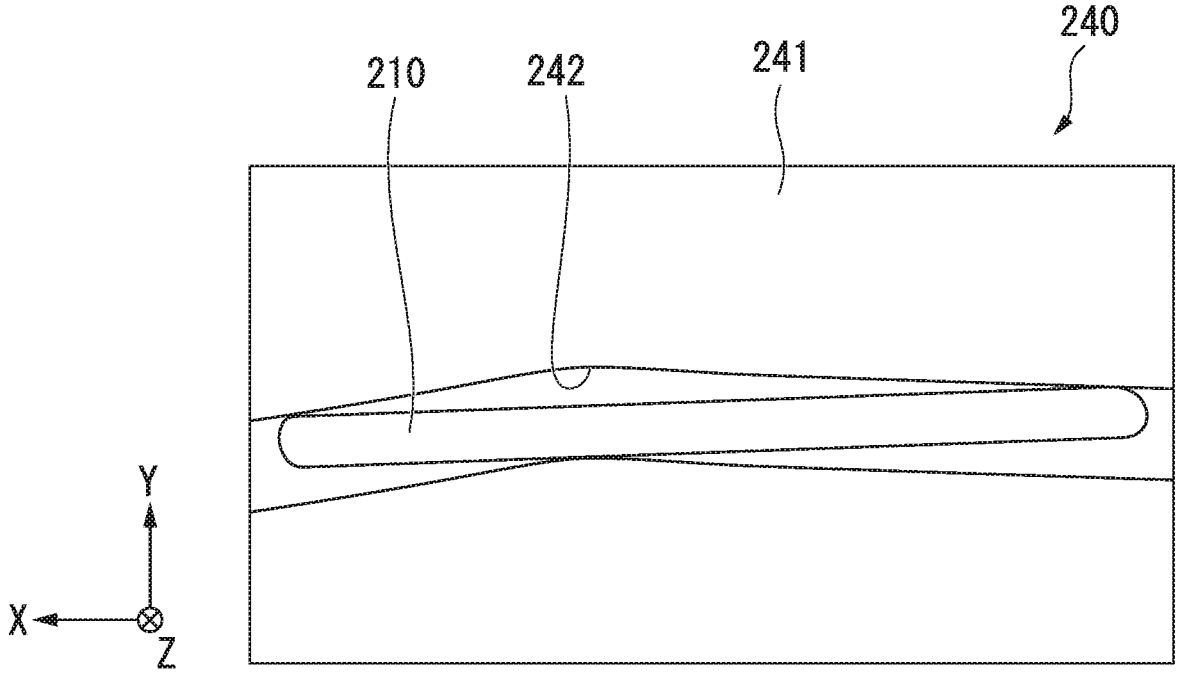
FIG. 29B is a plan view showing a lower die of the circular forming die.
Figure 29C:
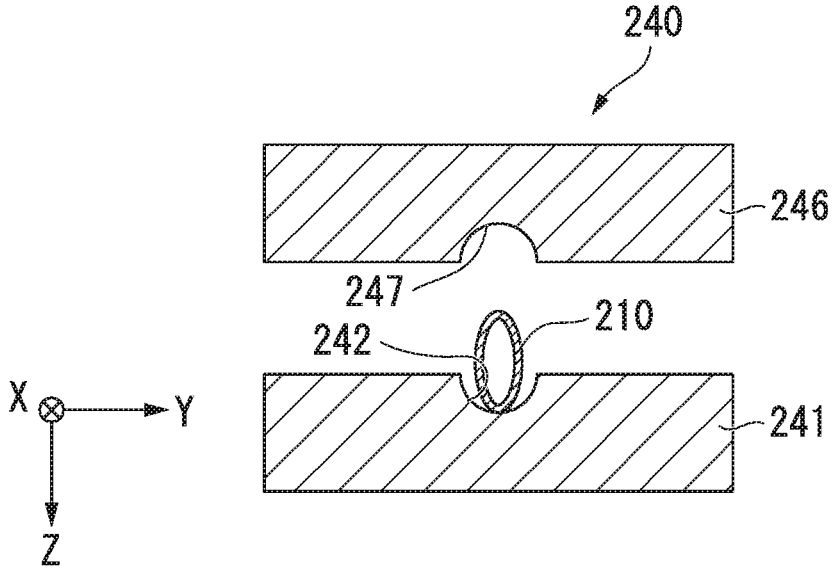
FIG. 29C is a transverse cross-sectional view showing the circular forming die.

FIG. 29A to FIG. 29C are views showing the circular forming die 240 that is used in the circular forming process S202. FIG. 29A is a perspective view of the circular forming die 240, FIG. 29B is a plan view of the circular forming die 240, and FIG. 29C is a transverse cross-sectional view of the circular forming die 240. Furthermore, the intermediate press-formed product 210 is not shown in FIG. 29A, and an upper die 246 of the circular forming die 240 is not shown in FIG. 29B.

As shown in FIG. 29A and FIG. 29C, the circular forming die 240 includes a lower die 241 and the upper die 246 that is disposed to face the lower die 241. In the circular forming die 240, the intermediate press-formed product 210 placed between the lower die 241 and the upper die 246 are pressed by lowering the upper die 246 along the Z-direction, thereby manufacturing the press-formed product 250.

A concave portion 242 having a semicircular cross-section is formed in the lower die 241 of the circular forming die 240 between both ends of the lower die 241 in the X-direction. The concave portion 242 includes a curved tubular portion forming section 242*b* for formation of a curved tubular portion 252 of the press-formed product 250, a straight tubular portion forming section 242*c* for formation of a straight tubular portion 251 of the press-formed product 250, and a straight tubular portion forming section 242*a* for formation of a straight tubular portion 253 of the press-formed product 250.

A concave portion 247 having a semicircular cross-section is formed in the upper die 246 of the circular forming die 240 between both ends of the upper die 246 of the semicircular concave portion 247 in the X-direction to face the concave portion 242 of the lower die 241. The concave portion 247 includes a curved tubular portion forming section 247*b* for formation of the curved tubular portion 252 of the press-formed product 250, a straight tubular portion forming section 247*c* for formation of the straight tubular portion 251 of the press-formed product 250, and a straight tubular portion forming section 247*a* for formation of the straight tubular portion 253 of the press-formed product 250.

When press-forming the intermediate press-formed product 210 by the circular forming die 240, the upper die 246 is lowered along the Z-direction until a bottom surface of the upper die 246 comes into contact with an upper surface of the lower die 241. In a state in which the bottom surface of the upper die 246 comes into contact with the upper surface of the lower die 241, a space is formed by the concave portion 242 of the lower die 241 and the concave portion 247 of the upper die 246. This space is set to a shape conforming to an external shape of the press-formed product 250, and when the intermediate press-formed product 210 is pressed, the outer surface of the intermediate press-formed product 210 becomes a shape conforming to the concave portion 242 of the lower die 241 and the concave portion 247 of the upper die 246.

As is the case with the first embodiment, in the circular forming process S202, as shown in FIG. 29B and FIG. 29C, the intermediate press-formed product 210 having an elliptical cross-section is placed in the concave portion 242 of the lower die 241 in such a manner that a major axis direction is parallel to the Z-direction. In addition, the upper die 246 is lowered in the Z-direction to press-form the intermediate press-formed product 210, thereby obtaining the press-formed product 250.

While the embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the gist of the inventions. The accompanying claims and their equivalents are intended to cover such forms or modifications as would fall within the scope and gist of the inventions.

For example, in the embodiments, a description has been provided of a case where the cross-section of the press-formed product has a hollow circular shape. However, the cross-section of the press-formed product may be set to a hollow elliptical shape or a hollow polygonal shape.

In addition, for example, in the first embodiment, a description has been provided of a case where the press-formed product 50 includes the first curved tubular portion 52 and the second curved tubular portion 54 one by one, but the press-formed product 50 may include a plurality of the first curved tubular portions 52 and a plurality of the second curved tubular portions 54.

In addition, for example, in the press-formed products according to the embodiments, a description has been provided of a case where the circumference, which continues in the X-direction, has approximately the same circular cross-section. However, the press-formed product may have a hollow cross-section in which the circumference varies in the X-direction.

In addition, for example, the press-formed product according to the embodiments may have a blade shape, a bracket, and the like.

In addition, for example, in the first embodiment, a description has been provided of a case where the welded portion is formed in the press-formed product 50 over the entire length. However, the welded portion may be formed at a part of the press-formed product.

Figure 30:
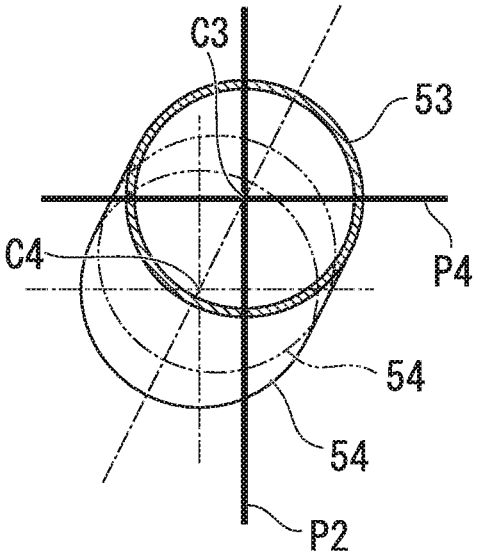
FIG. 30 is a cross-sectional view taken along line A-A in FIG. 2A, and is a view showing another example of the press-formed product of the first embodiment.

In addition, for example, in the press-formed product 50 according to the first embodiment, a description has been provided of a case where the axial line C4 of the second curved tubular portion 54 is formed in the plane P4 that is perpendicular to the plane P2 including the axial lines C1, C2, and C3 of the straight tubular portion 51, the first curved tubular portion 52, and the straight tubular portion 53, and includes the axial line C3 of the straight tubular portion 53 (refer to FIG. 2C). However, for example, as shown in FIG. 30, the second curved tubular portion 54 may be formed in such a manner that a line connecting the axial line C3 of the straight tubular portion 53 and the axial line C4 of the second curved tubular portion 54 intersect both the plane P2 and the plane P4.

In addition, for example, in the first embodiment, a description has been provided of a case of executing the trimming process S2 between the U-bending forming process S1 and the elliptical forming process S3. However, in a case where the excess metal 14 does not occur in the intermediate press-formed product 10 obtained in the U-bending forming process S1 through appropriate adjustment of the width of the flat plate 1, the trimming process S2 is not necessary.

In addition, for example, in the first embodiment, a description has been provided of a case of press-forming the flat plate 1 to have a U-shaped cross-section and forming the curved portion 12 corresponding to the first curved tubular portion 52 of the press-formed product 50 in the U-bending forming process S1. However, after press-forming the flat plate 1 to have the U-shaped cross-section, the flat plate 1 may be further press-formed to form the curved portion 12.

In addition, in the embodiments, for example, a description has been provided of a case where the upper die of the forming die advances to or retreats from the lower die. However, the upper die and the lower die may relatively approach each other or be relatively spaced away from each other without limitation to the case.

INDUSTRIAL APPLICABILITY

According to the invention, it is possible to provide a method of manufacturing a press-formed, and a press-formed product capable of limiting the occurrence of forming a defect such as a depression when forming a bent portion by pressing a hollow material.

BRIEF DESCRIPTION OF THE REFERENCE SYMBOLS

1: FLAT PLATE
10: INTERMEDIATE PRESS-FORMED PRODUCT (FLAT PLATE AFTER U-BENDING FORMING PROCESS S1)
20: INTERMEDIATE PRESS-FORMED PRODUCT (FLAT PLATE AFTER TRIMMING PROCESS S2)
30: INTERMEDIATE PRESS-FORMED PRODUCT (FLAT PLATE AFTER ELLIPTICAL FORMING PROCESS S3)
40: INTERMEDIATE PRESS-FORMED PRODUCT (FLAT PLATE AFTER JOINING PROCESS S4)
50: PRESS-FORMED PRODUCT (FIRST EMBODIMENT)
100: U-BENDING FORMING DIE
110: BLANK HOLDER TOOL
120: TRIMMING DIE
130: ELLIPTICAL FORMING DIE
140: CIRCULAR FORMING DIE
201: CYLINDRICAL TUBE
210: INTERMEDIATE PRESS-FORMED PRODUCT (SECOND EMBODIMENT)
230: ELLIPTICAL FORMING DIE (SECOND EMBODIMENT)
240: CIRCULAR FORMING DIE (SECOND EMBODIMENT)
250: PRESS-FORMED PRODUCT (SECOND EMBODIMENT)

The invention claimed is:

1. A method of manufacturing a press-formed product, the method comprising:

a first process of preparing a material that extends in a first direction (X), and when viewed in a cross-section perpendicular to the first direction (X), the cross-section is a hollow cross-section that is elongated in a second direction (Z) perpendicular to the first direction (X), and a straight portion that is straight in a third direction (Y); and a second process of placing the material in a forming die such that a long axis direction of the hollow cross-section is parallel to the second direction (Z) and the straight portion of the material includes portions that approach the die at different positions along the first direction (X) in a plan view and producing a bending moment from the different positions that is applied to the material in the third direction (Y) intersecting the second direction (Z) when viewed from the first direction (X) via concave portions of a respective upper die and lower die, by pressing the material along the second direction (Z) while maintaining the hollow cross-section, thereby bending the straight portion of the material.

2. The method of manufacturing a press-formed product according to claim 1, wherein the first process includes:

a flat plate bending process of pressing a flat plate along a thickness direction of the flat plate so that both ends in a width direction of the flat plate face each other; and a butting process of butting edges of the both ends of the flat plate after the flat plate bending process, and wherein the flat plate after the butting process is used as the material.

3. The method of manufacturing a press-formed product according to claim 2, wherein the first process further includes a joining process of joining the edges of the flat plate after the butting process.

4. The method of manufacturing a press-formed product according to claim 2, wherein in the flat plate bending process, the flat plate is pressed in the thickness direction to allow the both ends in the width direction of the flat plate to face each other and to bend the flat plate in the thickness direction.

5. The method of manufacturing a press-formed product according to claim 1, wherein in the second process, the material is pressed in stages along the second direction.

6. The method of manufacturing a press-formed product according to claim 3, wherein in the flat plate bending process, the flat plate is pressed in the thickness direction to allow the both ends in the width direction of the flat plate to face each other and to bend the flat plate in the thickness direction.

7. The method of manufacturing a press-formed product according to claim 2, wherein in the second process, the material is pressed in stages along the second direction.

8. The method of manufacturing a press-formed product according to claim 3, wherein in the second process, the material is pressed in stages along the second direction.

9. The method of manufacturing a press-formed product according to claim 4, wherein in the second process, the material is pressed in stages along the second direction.

* * * * *